US012181253B2

(12) United States Patent
Roby et al.

(10) Patent No.: US 12,181,253 B2
(45) Date of Patent: Dec. 31, 2024

(54) RIOT GEAR

(71) Applicant: Sirchie Acquisition Company, LLC., Youngsville, NC (US)

(72) Inventors: John Roby, Youngsville, NC (US); Jason Emerline, Raleigh, NC (US); Andrew Mariella, Raleigh, NC (US); Thomas Africa, Lebanon, OH (US); Kevin Vititoe, Westerville, OH (US); Sherry Jones, Pataskala, OH (US); Oren Shai, Westerville, OH (US); Lauren Angell, Pataskala, OH (US)

(73) Assignee: Sirchie Acquisition Company, LLC., Youngsville, NC (US)

( * ) Notice: Subject to any disclaimer, the term of this patent is extended or adjusted under 35 U.S.C. 154(b) by 0 days.

(21) Appl. No.: 17/162,558

(22) Filed: Jan. 29, 2021

(65) Prior Publication Data

US 2021/0310769 A1 Oct. 7, 2021

Related U.S. Application Data

(63) Continuation of application No. 15/730,375, filed on Oct. 11, 2017, now abandoned, which is a (Continued)

(51) Int. Cl.
*F41H 1/00* (2006.01)
*A41D 13/05* (2006.01)
(Continued)

(52) U.S. Cl.
CPC ..... *F41H 1/00* (2013.01); *A41D 13/0506* (2013.01); *A41D 13/0512* (2013.01);
(Continued)

(58) Field of Classification Search
CPC ... F41H 1/02; A41D 13/0506; A41D 13/0543; A41D 13/055; A41D 13/0556;
(Continued)

(56) References Cited

U.S. PATENT DOCUMENTS 570,067 A 10/1896 Stevenson
1,772,922 A * 8/1930 Volz ..... A63B 71/1225 2/22
(Continued)

FOREIGN PATENT DOCUMENTS

GB 2221286 A * 1/1990 ..... F41H 5/08
WO 2002078799 A1 10/2002

OTHER PUBLICATIONS

International Search Report dated Jun. 27, 2017, issued in related PCT/US2017/026814.
(Continued)

*Primary Examiner* — Aiying Zhao
(74) *Attorney, Agent, or Firm* — McGuire Woods LLP

(57) ABSTRACT

A body protection system comprising multiple protective assemblies that permits adjustability of the multiple assemblies in respect to one another thereby permitting a complete body protection system that is usable across different size personnel. The multiple protective assemblies may be separately adjusted permitting a one-size-fits-most capability for the different sized personnel. The body protection system permits reuse among different sized people thereby reducing overall costs associated with protecting members of law enforcement, military or other organizations. The body protection system may include a unique adjustable neck protectors that provides enhanced protection for the neck area. The various multiple protective assemblies may sus-
(Continued)

pend directly or indirectly from the shoulder pad assemblies providing a common comprehensive suspension system for a wearer.

4 Claims, 19 Drawing Sheets

Related U.S. Application Data continuation-in-part of application No. 15/480,049, filed on Apr. 5, 2017, now abandoned.

(51) Int. Cl.

| | |
|---|---|
| ***A41D 13/06*** | (2006.01) |
| ***A41D 13/08*** | (2006.01) |
| ***A41D 27/20*** | (2006.01) |
| ***A63B 71/12*** | (2006.01) |
| ***F41H 1/02*** | (2006.01) |

(52) U.S. Cl.

CPC ..... *A41D 13/0518* (2013.01); *A41D 13/0543* (2013.01); *A41D 13/0562* (2013.01); *A41D 13/0568* (2013.01); *A41D 13/065* (2013.01); *A41D 13/08* (2013.01); *A41D 27/201* (2013.01); *A63B 71/1225* (2013.01); *F41H 1/02* (2013.01); *A41D 2300/32* (2013.01); *A41D 2600/10* (2013.01); *A41D 2600/20* (2013.01); *A63B 2071/1208* (2013.01); *A63B 2071/1233* (2013.01); *A63B 2071/1241* (2013.01); *A63B 2071/125* (2013.01); *A63B 2071/1258* (2013.01); *A63B 2071/1283* (2013.01)

(58) Field of Classification Search

CPC ..... A41D 13/0562; A41D 13/0568; A63B 71/1225; A63B 2071/1233; A63B 2071/1241

USPC ..... 2/2.5, 22, 455, 456, 911, 908

See application file for complete search history.

(56) References Cited

U.S. PATENT DOCUMENTS

| | | | | |
|---|---|---|---|---|
| 4,455,686 | A * | 6/1984 | Zide | A41D 1/08 2/23 |
| 4,512,037 | A * | 4/1985 | Vacanti | A41D 13/1184 2/22 |
| 4,608,716 | A * | 9/1986 | Brumfield | A42B 3/166 2/403 |
| 4,610,035 | A | 9/1986 | Mattila | |
| 4,999,847 | A | 3/1991 | Barcelo | |
| 5,060,314 | A | 10/1991 | Lewis | |
| 5,204,993 | A | 4/1993 | Siemens | |
| 5,632,071 | A | 5/1997 | Maunder | |
| 5,732,411 | A | 3/1998 | Coleman et al. | |
| 5,943,695 | A | 8/1999 | Yen | |
| 6,178,556 | B1 | 1/2001 | Foreman et al. | |
| 6,205,583 | B1 | 3/2001 | Beland | |
| 6,272,682 | B1 | 8/2001 | Fullum | |
| 6,654,961 | B2 | 12/2003 | Beland | |
| 7,143,446 | B1 * | 12/2006 | Gionfriddo | F41H 1/02 2/2.5 |
| 7,237,270 | B2 | 7/2007 | Crye et al. | |
| 7,360,255 | B2 | 4/2008 | Whitmire | |
| 7,424,748 | B1 | 9/2008 | McDunn et al. | |
| 8,608,041 | B1 * | 12/2013 | Adkisson | A45F 3/04 2/102 |
| 8,683,908 | B1 * | 4/2014 | Lewis | F41H 1/02 2/2.5 |
| 8,745,765 | B1 * | 6/2014 | Ahlborn | A41D 31/24 2/22 |
| 9,222,757 | B2 | 12/2015 | Seuk | |
| 10,004,974 | B1 * | 6/2018 | Schneider | A63B 71/1225 |
| 2001/0044947 | A1 | 11/2001 | Heller et al. | |
| 2004/0216213 | A1 | 11/2004 | Paciorkowski | |
| 2006/0200887 | A1 * | 9/2006 | Bay | A41D 13/065 2/24 |
| 2007/0250977 | A1 | 11/2007 | Brown et al. | |
| 2008/0134419 | A1 * | 6/2008 | Kalaam | F41H 1/02 2/2.5 |
| 2009/0025126 | A1 * | 1/2009 | Crossman | F41H 1/02 2/2.5 |
| 2009/0282595 | A1 | 11/2009 | Branson et al. | |
| 2010/0212056 | A1 * | 8/2010 | Sullivan | F41H 1/02 2/2.5 |
| 2011/0030119 | A1 | 2/2011 | Fee et al. | |
| 2011/0231985 | A1 | 9/2011 | Bishop | |
| 2011/0277226 | A1 * | 11/2011 | Turner | A42B 3/125 2/463 |
| 2012/0180178 | A1 | 7/2012 | Gallo | |
| 2014/0007330 | A1 | 1/2014 | Smith et al. | |
| 2014/0245525 | A1 | 9/2014 | Turner | |
| 2014/0259324 | A1 * | 9/2014 | Behrend | A41D 13/0543 2/455 |
| 2014/0359912 | A1 | 12/2014 | Sutton | |
| 2015/0272244 | A1 | 10/2015 | Vito et al. | |
| 2015/0296899 | A1 | 10/2015 | Wyner et al. | |
| 2016/0255885 | A1 | 9/2016 | Henry et al. | |
| 2016/0279503 | A1 * | 9/2016 | Komlos | A63B 71/12 |
| 2017/0055603 | A1 | 3/2017 | Guidetti et al. | |

OTHER PUBLICATIONS

Security Pro USA, SecPRO RCS2 Riot Control Suite, Feb. 26, 2017.

CO Application No. NC20190010868—Office Action dated Aug. 24, 2022 (English).

* cited by examiner

RIOT GEAR

CROSS-REFERENCE TO RELATED APPLICATIONS

This application is a Continuation of U.S. patent application Ser. No. 15/730,375 filed Oct. 11, 2017, entitled "MOLLE-COMPATIBLE APPARATUS" which is a Continuation-in-Part of U.S. patent application Ser. No. 15/480,049 filed Apr. 5, 2017, entitled "RIOT GEAR" the disclosures of which are incorporated by reference herein in their entirety.

BACKGROUND

1.0 Field of the Disclosure

The present disclosure relates to a system and apparatus comprising various components for providing body protection for an individual and, more particularly, to a system, method and apparatus for providing body protection such as, e.g., riot gear for an individual that is adjustable for resizing to fit different sized individuals, including a modular lightweight load-carrying equipment (MOLLE) improvement, among other features.

2.0 Related Art

Protective gear such as used for law enforcement officers or military personnel is important for individual personal protection. At times, such personnel may be called upon to face adverse situations that could be unpredictable with potential of physical altercations.

Currently available protective gear tends to be cumbersome for an individual to put on. Moreover, a particular set of protective gear is unable to conform to a wide range of body sizes, often requiring stocking of many different sizes of components.

A protective gear system or assembly that can be used across a wider range of body sizes and provides added features to assist in the individual's duty, especially in a time of an emergency or a riot would be an advantageous development for use by law enforcement and military personnel.

SUMMARY OF THE DISCLOSURE

In one aspect, a body protection system is provided comprising: at least one shoulder pad assembly, a torso assembly comprising a front torso assembly and a rear torso assembly both the front torso assembly and a rear torso assembly adjustably connectable to the at least one shoulder pad assembly, at least one thigh protector assembly adjustably connectable to the torso assembly and at least one leg protector assembly adjustably connectable to the at least one thigh protector assembly. The body protection system may further comprise at least one foot protector adjustably connectable to the at least one leg protector assembly. The body protection system may further comprise a front neck protector connected to the front torso assembly and a rear neck protector adjustably connectable to the rear torso assembly and the at least one shoulder pad assembly.

The body protection system may further comprise at least one upper arm protector adjustably connectable to the at least one shoulder pad assembly and at least one lower arm protection assembly adjustably connectable to the at least one upper arm protector. The at least one shoulder pad assembly may comprise two shoulder pad assemblies and the at least one upper arm protector may comprise two upper arm protectors adjustably connectable to the two shoulder pad assemblies, and the at least one lower arm protection assembly may comprise two lower arm protection assemblies connectable to a respective one of the two upper arm protectors. The at least one lower arm protection assembly may comprise an elbow protector adjustably connectable to the at least one upper arm protector, an outer plate attached to an outer pad, the outer plate and outer pad configured to be adjustably connectable to the elbow protector, the outer plate positionable for protecting an outer portion of a forearm and an inner plate attached to an inner pad the inner plate positionable for protecting an inner portion of a forearm, wherein the inner plate and outer plate are adjustably connectable to one another for permitting for a wide range of forearm circumferences. The elbow protector may be configured to form a concave cavity for receiving an elbow therewithin. The elbow protector may comprise an elbow liner configured with a concave cavity and comprising a solid foam material and a flexible elbow hammock positionable adjacent the elbow liner and configured to be adjustably attachable to a wearer by a plurality of adjustable straps, the plurality of adjustable straps also passing through the elbow liner.

In one aspect, the shoulder pad assembly may comprise a shoulder plate permanently attached to a shoulder pad, and the shoulder plate may comprise an elevated portion proximate a neck end for additional protection to the neck area. The shoulder pad assembly may further comprise an adjustable attaching mechanism for attaching at least one rear neck protector.

In one aspect, the at least one thigh protector assembly may comprise an upper portion comprising two straps for attaching the at least one thigh protector to a belt, the two straps defining a space therebetween for permitting attaching of a hip pad or holster to the belt through the defined space, a lower portion comprising a plurality of thigh plates attached to a thigh pad, the plurality of thigh plates defining a hinge area therebetween and configured to permit the at least one thigh protector to be opened and placed about a thigh of a wearer. The hinge may permit opening and placing of the thigh protector about a wide range of thigh circumferences. The lower portion may comprise at least one rib extending laterally from a face of one of the thigh plates for receiving and supporting a shield thereon. The at least one rib may comprise at least one post extending vertically from a top of the at least one rib for assisting in keeping a shield in place on the at least one rib. The lower portion may comprise at least one notch formed in a top edge of one of the thigh plates for assisting in keeping a shield in place on the at least one thigh protector assembly. The body protection system may further comprise an adjustable securing mechanism for closing the lower portion about a thigh of a wearer.

In one aspect, the at least one leg protector assembly may comprise a knee guard adjustably connectable to the at least one thigh protector assembly, a shin guard plate adjustably connectable to the knee guard, the shin guard plate may comprise an upper leg pad permanently attached to the shin guard plate, a lower leg pad removably attachable to the upper leg pad, the lower leg pad configured to be repositionable along a lower leg of a wearer and an adjustable securing mechanism configured to secure the shin guard plate and upper leg pad about a leg of a wearer.

In one aspect, the front torso assembly may comprise a chest pad adjustably connectable to the at least one shoulder pad assembly, an adjustable plate pocket adjustably connected to the chest pad for receiving a plate therewithin and a lower abdominal pad configured with a recess along a top of the lower abdominal pad for receiving a belt therewithin, the lower abdominal pad releasably connectable to an inner side of the chest pad. The front torso assembly may further comprise one or more adjustable arm pads releasably connectable to the chest pad, the one or more adjustable arm pads for protecting the rib area of a wearer, the plate insertable in the adjustable plate pocket, a flap secured to an inner side of the chest pad for adjustably securing the plate within the adjustable plate pocket and at least one adjustable connecting strap configured to connect the chest pad to a back pad. The adjustable plate pocket may include a plurality of anchor points for attachment of modular lightweight load-carrying equipment (MOLLE) compatible (i.e., MOLLE-compatible) accessories to the adjustable plate pocket, the plurality of anchor points arranged at about 90 degree angles to one another, thereby permitting easier access to any attached MOLLE-compatible accessories. The back torso assembly may comprise a back pad adjustably connectable to the at least one shoulder pad assembly, an adjustable plate pocket adjustably connected to the back pad for receiving a plate therewithin, a lower back pad configured with a recess along a top of the lower back pad for receiving a belt therewithin, the lower back pad releasably connectable to an inner side of the back pad and at least one adjustable connecting strap to connect the back pad to the front torso assembly. The back torso assembly may further comprise a plurality of handles permanently attached to the rear torso protector assembly at a plurality of locations for easier lifting of a downed individual. The front torso assembly may further comprise a plurality of rescue straps permanently attached to the front torso protector assembly at a plurality of locations for easier lifting of a downed individual.

In one aspect, a method of providing body protection may include providing two shoulder pad assemblies, each shoulder pad assembly comprising a shoulder plate, the shoulder plate configured with a raised portion at one end for protecting a neck area, providing a torso assembly comprising a front torso assembly and a rear torso assembly, both the front torso assembly and the rear torso assembly adjustably connectable to the two shoulder pad assemblies, the front torso assembly and the rear torso assembly each comprising an adjustable plate pocket for receiving a plate therewithin, the rear torso assembly and the front torso assembly comprising a plurality of handles permanently attached at a plurality of locations to the rear torso protector assembly and the front torso assembly for easier lifting of a downed individual.

The method of providing body protection may further include providing a plurality of thigh protector assemblies, each adjustably connectable to the torso assembly, providing a plurality of leg protector assemblies adjustably connectable to the plurality of thigh protector assemblies, providing a plurality of foot protectors adjustably connectable to the plurality of leg protector assemblies, providing a front neck protector adjustably connectable to the front torso assembly and a rear neck protector adjustably connectable to the rear torso assembly, providing a plurality of upper arm protectors adjustably connectable to the two shoulder pad assemblies and providing a plurality of lower arm protection assemblies adjustably connectable to the plurality of upper arm protectors. The plate may comprise a ballistic plate.

In one aspect, at least one lower arm protection assembly is provided that includes an elbow protector adjustably connectable to the at least one upper arm protector, an outer plate attached to an outer pad, the outer plate and outer pad configured to be adjustably connectable to the elbow protector, the outer plate positionable for protecting an outer portion of a forearm and an inner plate attached to an inner pad the inner plate positionable for protecting an inner portion of a forearm, the inner plate and the outer plate are adjustably connectable to one another for permitting for a wide range of forearm circumferences. The elbow protector may be configured to form a concave cavity for receiving an elbow therewithin, the elbow protector may comprise an elbow liner configured with a concave cavity and comprising a solid foam material and a flexible elbow hammock positionable adjacent the elbow liner and configured to be adjustably attachable to a wearer by a plurality of adjustable straps, the plurality of adjustable straps also passing through the elbow liner.

In one aspect, a thigh protector assembly is provided and may comprise an upper portion comprising two straps for attaching the at least one thigh protector to a belt, the two strap defining a space therebetween for permitting attaching of a hip pad or holster to a belt through the defined space, a lower portion comprising a plurality of thigh plates attached to a thigh pad, the plurality of thigh plates defining a hinge area therebetween configured to permit the at least one thigh protector to be opened and placed about a thigh of a wearer. The hinge may permit opening and placing of the thigh protector about a wide range of thigh circumferences. The lower portion may comprise at least one rib extending laterally from a face of one of the thigh plates for receiving and supporting a shield thereon. The at least one rib may comprise at least one post extending vertically from a top of the at least one rib for assisting in keeping a shield in place on the at least one rib. The lower portion may comprise at least one notch formed in a top edge of one of the thigh plates for assisting in keeping a shield in place on the at least one thigh protector assembly.

In one aspect, a leg protector assembly is provided comprising a knee guard adjustably connectable to the at least one thigh protector assembly, a shin guard plate adjustably connectable to the knee guard, the shin guard plate comprising an upper leg pad permanently attached to the shin guard plate, a lower leg pad removably attachable to the upper leg pad, the lower leg pad configured to be repositionable along a lower leg of a wearer and an adjustable securing mechanism configured to secure the shin guard plate and upper leg pad about a leg of a wearer.

In one aspect, a MOLLE-compatible pocket includes a pocket formed in conjunction with a chest pad, the pocket may be configured with a plurality of vertical channels positioned along a left side and a right side of the pocket, the plurality of vertical channels for receiving an adjustable chord therethrough for adjusting to different thickness of interchangeable plates insertable within the pocket, the pocket may comprise a plurality of 45 degree anchor points to permit attachment of MOLLE-compatible pouches or accessories. The plurality of 45 degree anchor points may be arranged as a plurality of different rows oriented at 90 degree angles to one another. The plurality of 45 degree anchor points may be arranged as a plurality of different rows oriented at 90 degree angles to one another and the different rows interspersed among one another. The plurality of vertical channels may be positioned to receive therebetween another vertical channel connected to the chest pad, the another vertical channel configured to receive the adjustable chord therethrough to secure the left side and the right side to the chest pad. The pocket may include at least one flap located at the bottom of the pocket for securing an interchangeable plate within the pocket and against the chest pad. The pocket may be adjustable in relation to the chest pad for adjusting to different thickness of interchangeable plates insertable therebetween.

In one aspect, a MOLLE-compatible pocket may include a pocket formed in relation with and connected to a pad, the pocket may be configured with a plurality of adjustable connecting mechanisms positioned along a left side and a right side of the pocket, the plurality of adjustable connecting mechanisms may be adjustable to different thickness of interchangeable plates insertable within the pocket, the pocket may comprise a plurality of 45 degree anchor points to permit attachment of MOLLE-compatible pouches or accessories.

BRIEF DESCRIPTION OF THE DRAWINGS

The accompanying drawings, which are included to provide a further understanding of the disclosure, are incorporated in and constitute a part of this specification, illustrate embodiments of the disclosure and, together with the detailed description, serve to explain the principles of the disclosure. No attempt is made to show structural details of the disclosure in more detail than may be necessary for a fundamental understanding of the disclosure and the various ways in which it may be practiced. In the drawings.

Figure 1A:
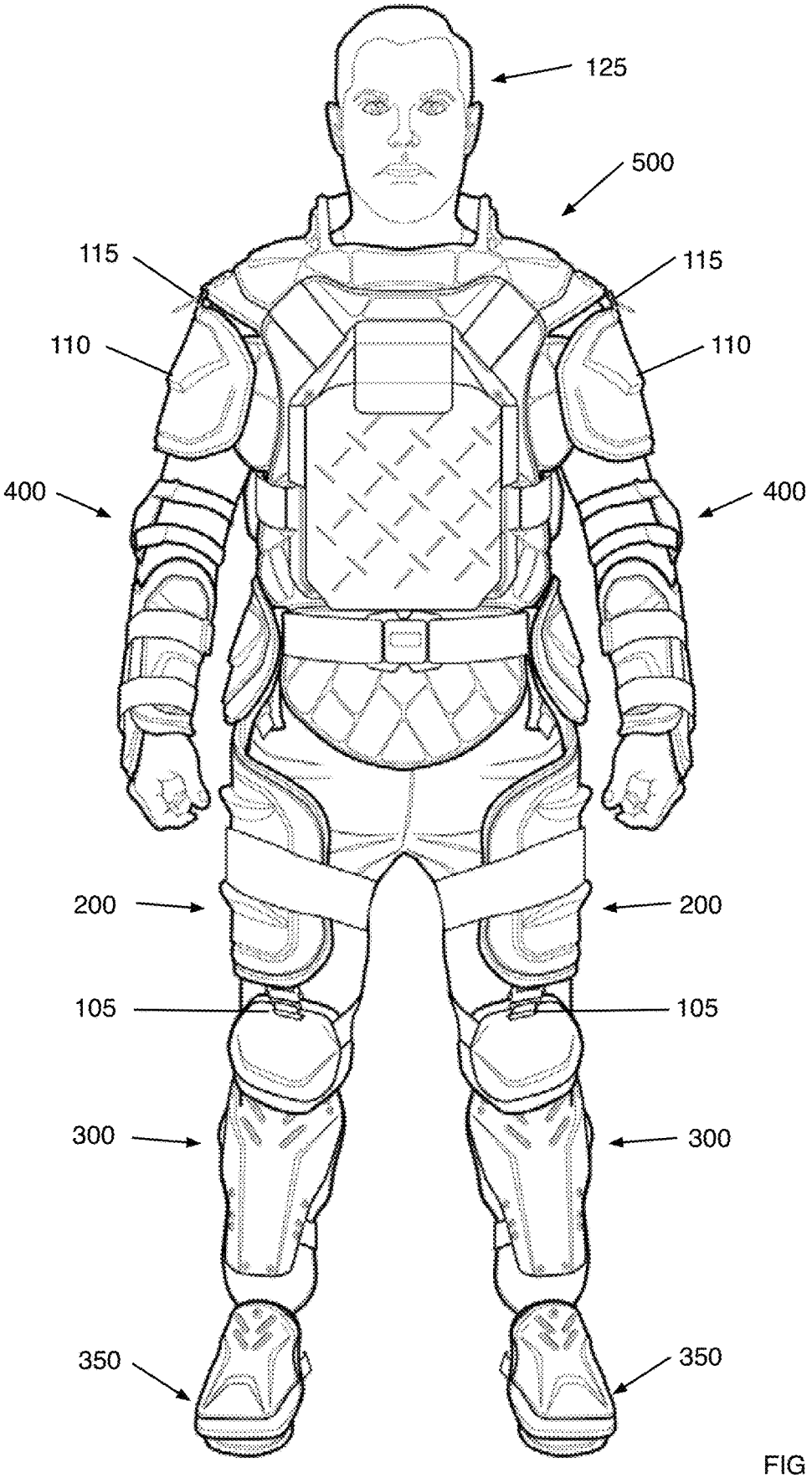
FIG. 1A is a front view and FIG. 1B is a back view of a protective gear system, configured according to principles of the disclosure.

The present disclosure is further described in the detailed description that follows.

DETAILED DESCRIPTION OF THE DISCLOSURE

The disclosure and the various features and advantageous details thereof are explained more fully with reference to the non-limiting examples that are described and/or illustrated in the accompanying drawings and detailed in the following description and attachment. It should be noted that the features illustrated in the drawings are not necessarily drawn to scale, and features of one example may be employed with other examples as the skilled artisan would recognize, even if not explicitly stated herein. Descriptions of well-known components and processing techniques may be omitted so as to not unnecessarily obscure the examples of the disclosure. The examples used herein are intended merely to facilitate an understanding of ways in which the invention may be practiced and to further enable those of skill in the art to practice the examples of the disclosure. Accordingly, the examples herein should not be construed as limiting the scope of the invention.

The terms "including", "comprising" and variations thereof, as used in this disclosure, mean "including, but not limited to", unless expressly specified otherwise.

The terms "a", "an", and "the", as used in this disclosure, means "one or more", unless expressly specified otherwise. The term "about" means within plus or minus 10%, unless context indicates otherwise.

Devices that are in communication with each other need not be in continuous communication with each other, unless expressly specified otherwise. In addition, devices that are in communication with each other may communicate directly or indirectly through one or more intermediaries.

Although process steps, method steps, algorithms, or the like, may be described in a sequential order, such processes, methods and algorithms may be configured to work in alternate orders. In other words, any sequence or order of steps that may be described does not necessarily indicate a requirement that the steps be performed in that order. The steps of the processes, methods or algorithms described herein may be performed in any order practical. Further, some steps may be performed simultaneously.

When a single device or article is described herein, it will be readily apparent that more than one device or article may be used in place of a single device or article. Similarly, where more than one device or article is described herein, it will be readily apparent that a single device or article may be used in place of the more than one device or article. The functionality or the features of a device may be alternatively embodied by one or more other devices which are not explicitly described as having such functionality or features.

Protection gear that is used in situations such as, e.g. riot control, is often ordered, maintained and stored by an organization, e.g., city, station, precinct, school, or other entity. As such ordering gear that fits all of its officers or personnel who may be with the organization for a relatively short time, e.g., a year or two, can be complicated and can cost added expense to sufficiently protect a wide range of officers or individuals who are of different body sizes, and may be continuously rotating in and out of the organization. This may also apply to sports team that purchases and maintains protective gear for its members. In one aspect, the principles of this disclosure provides for adjustable assemblies employing adjustable strapping options between the various assemblies, and across different body areas, to create a single adjustable protection system that fits most participants or members of the organization.

Figure 1B:
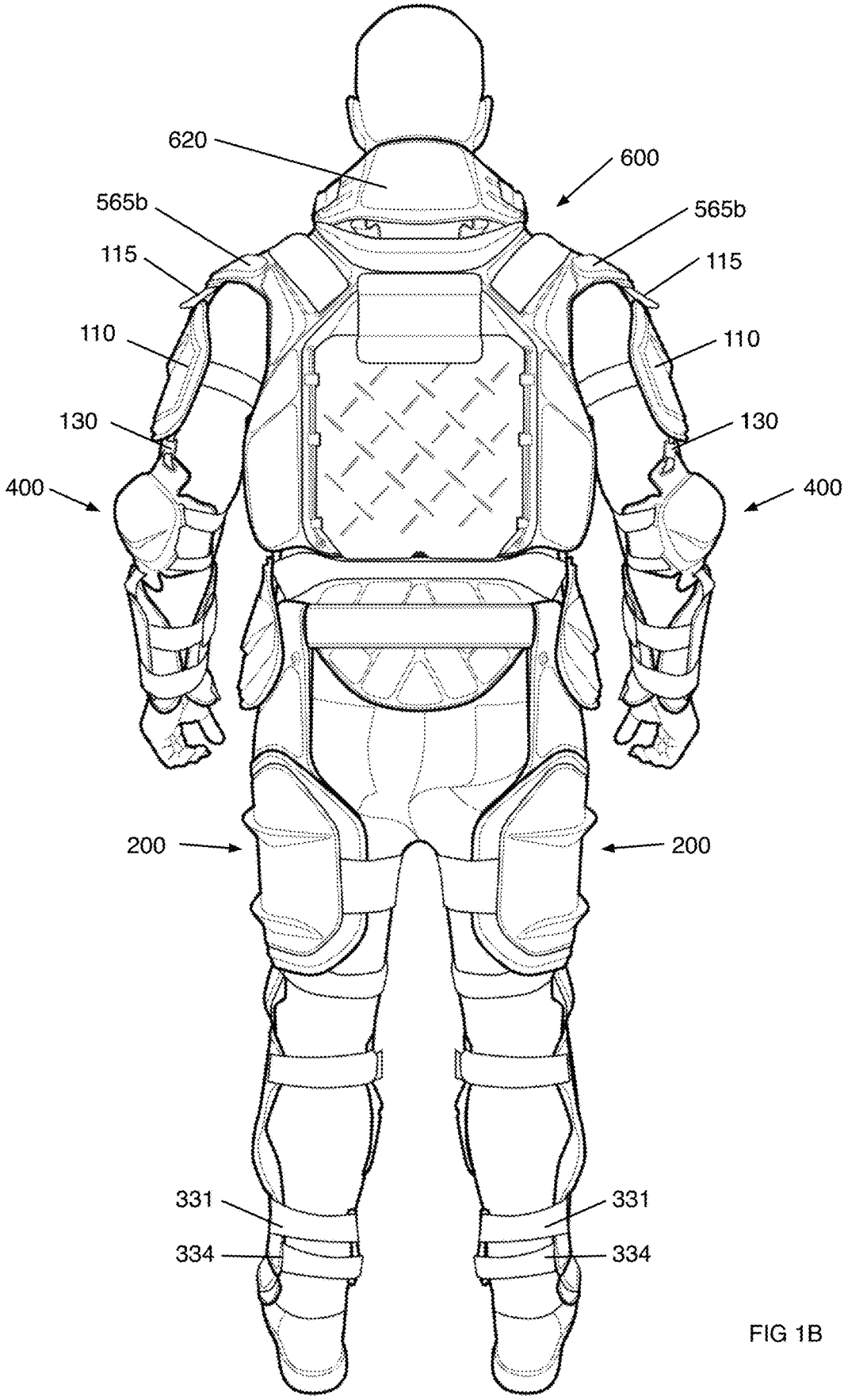

FIG. 1A is a front view and FIG. 1B is a back view of a protective gear system 1, configured according to principles of the disclosure. The protective gear system 1 provides a one-size-fits-most protection system for most individuals. The protective gear system may be employed by law enforcement officers, military, athletes such as hockey players, or an individual 125 where protection against impact force may be desired. The protective gear system 1 may provide a cost savings to agencies, schools, or companies because individuals of differing sizes can use the same protective gear system 1 thereby possibly reducing the number of systems needed to be purchased.

As described in more detail below, protective gear system 1 may comprise one or more thigh protection assembly 200, a leg protection assembly 300 including one or more foot protectors 350, an upper arm protector 110, one or more lower arm protection assemblies 400 and a torso protection assembly 500, 600. The upper arm protector 110 may be adjustably connected to torso assembly 500, 600 and also to the one or more lower arm assemblies 400 by connecting mechanisms 115 and 130. Connecting mechanisms 115 and 130 may employ a quick release buckle type technique. Either or both of the connecting mechanisms 115 and 130 may be adjustable to permit independent positioning of an upper arm protector 110 along an arm and also independent positioning of the lower arm assembly 400 along an arm to permit a one-size-fits-most capability. The leg protection assembly 300 may be adjustably connected to the thigh protection assembly 200 using an attaching mechanism 105 that permits position adjustment along a leg. In this manner, the leg protection assembly 300 may be repositionable along a leg of an individual 125 with respect to the thigh protection assembly 200 to support a one-size-fits-most system. Attaching mechanism 105 may employ a quick release buckle type technique.

Figure 2A:
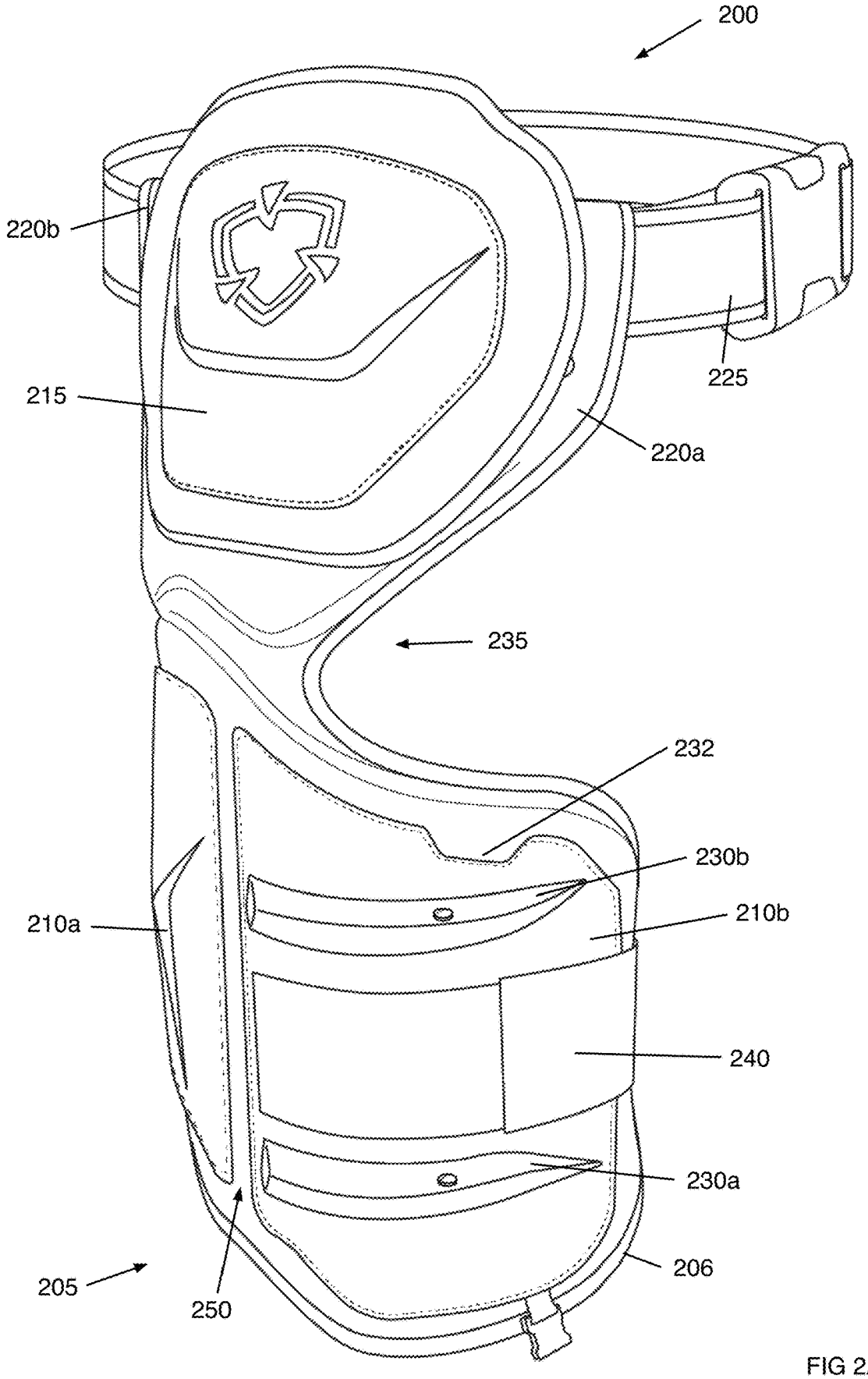
FIG. 2A is a perspective view of a thigh protector assembly, configured according to principles of the disclosure.
Figure 2B:
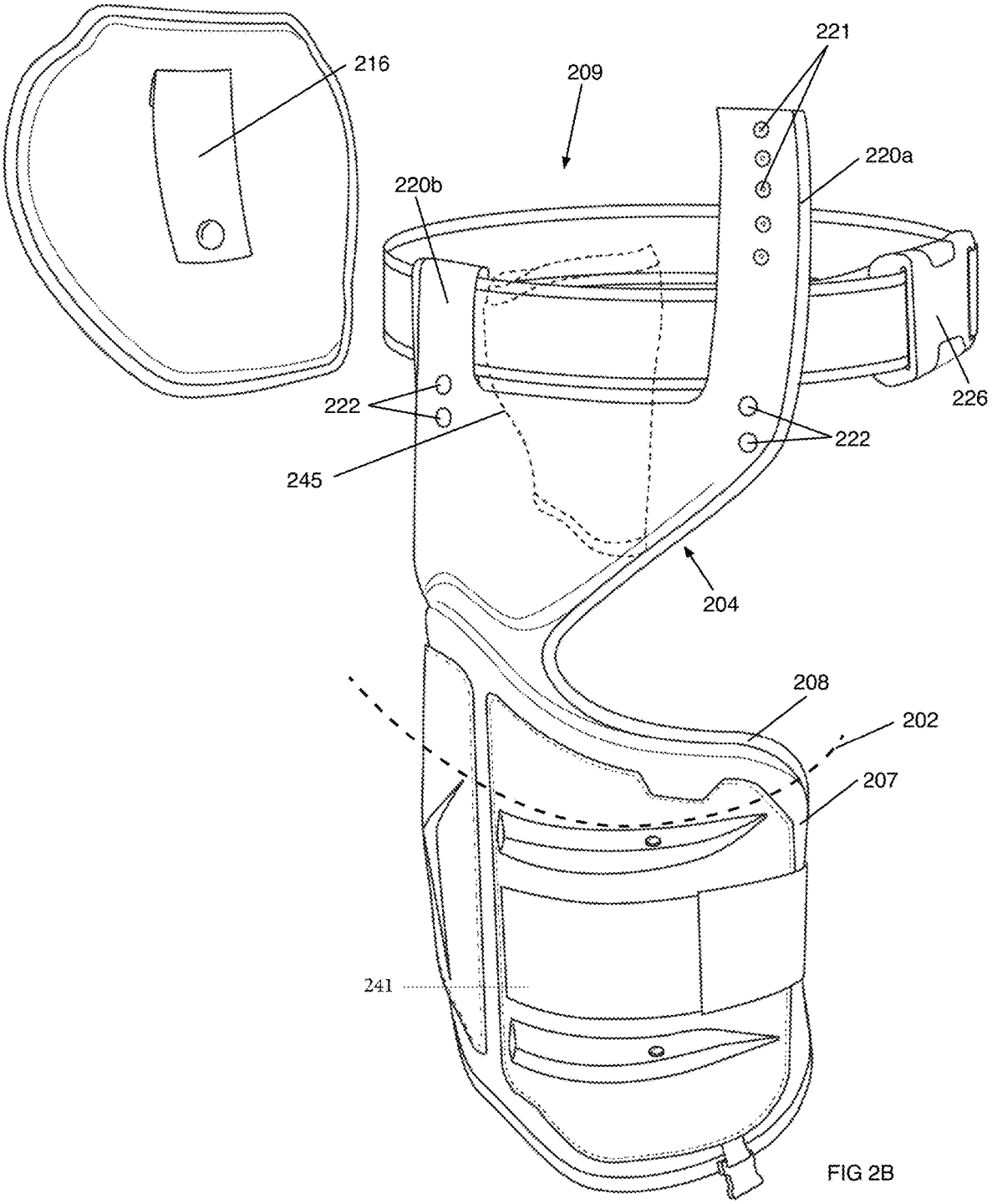
FIG. 2B is a perspective view of the thigh protector assembly of FIG. 1A, but showing a replaceable component, and attaching mechanism detail, configured according to principles of the disclosure.
Figure 2C:
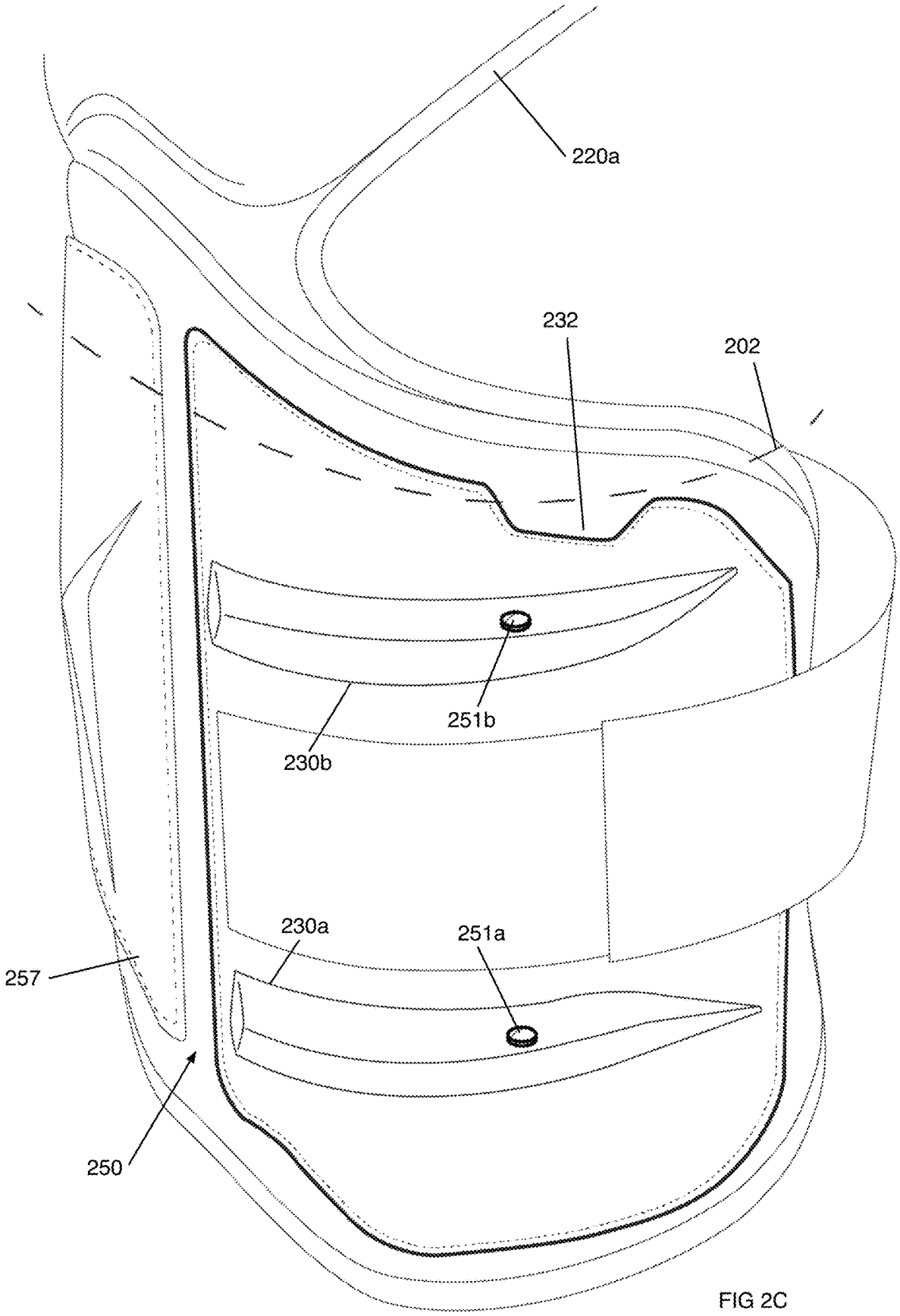
FIG. 2C is a close-up view of a lower portion of an example of a thigh protector assembly, configured according to principles of the disclosure.

FIG. 2A is a perspective view of a thigh protector assembly 200, configured according to principles of the disclosure. FIG. 2B is a perspective view of the thigh protector assembly of FIG. 1A, but showing a replaceable component, and attaching mechanism detail, configured according to principles of the disclosure. FIG. 2C is a close-up view of a lower portion of an example of a thigh protector assembly, configured according to principles of the disclosure.

There may be a thigh protector assembly 200 positioned about each thigh of a wearer, only one thigh protector assembly is described in relation to FIGS. 2A-2C, but a second thigh protector assembly 200 may be employed in a similar manner on the second leg of an individual, as shown in FIGS. 1A, 1B. Thigh protector assembly 200 includes a lower portion 205 and an upper portion 204 comprising two straps 220*a*, 220*b* that may be configured to fold over a belt 225 and fasten to itself, e.g. via a securing mechanism such as posts 221 and receiving hole 222, permitting adjustable positions offering a range of height/length options for a wearer. Other securing techniques may be employed such as, e.g., snap connectors, hooks, buttons or the like. Buckle 226 may secure the belt 225 about a wearer. The two straps 220*a*, 220*b* form a U-shaped space 209 therebetween, but could be other shapes such as, e.g., a V-shaped or rectangular shaped. The upper portion including the two straps 220*a*, 220*b* may connect with the lower portion 205 proximate a narrowed indented portion 235. The narrowed indented portion 235 may include a radius along an outer edge. The narrowed indented portion 235 may reduce surface area on the thigh for comfort and may permit more flexibility overall.

The lower portion 205 may comprise a base pad 206 to which a plurality of thigh plates 210*a*, 210*b* may be attached thereto such as, e.g., by being sewn 257 to the base pad 206. Thigh plates 210*a*, 210*b* may comprise a solid, durable material such as, e.g. a metal material or a composite material, of sufficient strength to absorb and/or deflect substantial energy that may be imparted against the thigh plates 210*a*, 210*b* while protecting a thigh of a wearer. The plurality of thigh plates 210*a*, 210*b* may provide a secure fit about a wear's thigh while also being somewhat flexible proximate a vertical midpoint section between the plurality of thigh plates 210*a*, 210*b* establishing a flex-hinge 250 at the midpoint section to permit the two sections of the lower portion to open somewhat when being placed on a wearer's thigh thereby permitting use for a wider range of thigh circumferences and for more adjustability while maintaining snug contact with the thigh. Each of the two sections configured with one of the plurality of thigh plates 210*a*, 210*b* thereon. For example, the thigh circumference range may be from about 18 to about 37 inches, but may be greater or less, e.g., 20-34 inches. The two sections 207, 208 of the lower portion 250 upon which the plates 210*a* and 210*b* are respectively attached may be secured to one another by an adjustably securing mechanism, 240, which may include a loop and hook type connecting technique, to secure the lower portion 205 around the thigh and/or for closing the lower portion 250 about a thigh of a wearer. A securing portion 241, which may be the loop portion or, conversely, the hook portion of a loop and hook connector, may be fixed to and extend across the entire width of the thigh plate 210*b*, for facilitating length adjustment for different sized thighs.

Thigh plate 210*b* may be oriented on the forefront of a wearer's thigh when thigh protector assembly 200 is being worn, and may be configured with one or more ribs 230*a*, 230*b* that may extend horizontally or laterally outward from a front face of plate 210*b*. The one or more ribs 230*a*, 230*b* may be configured to provide a ledge for the wearer to rest a shield 202. For example, a law officer wearing the thigh protector assembly 200 may be called to carry a shield 202 for use in the line of duty. The shield may be placed in any one of the ribs 230*a*, 230*b* thereby assisting in holding the shield 202 to reduce fatigue, or to provide an improved manner of bracing the shield 202 itself against a leg of the officer. The one or more ribs 230*a*, 230*b* may be configured with a post 251*a*, 251*b* or tabs extending vertically from the one or more ribs 230*a*, 230*b* to assist in keeping a shield 202 lodged behind the post 251*a*, 251*b* on a rib 230*a*, 230*b*.

Thigh plate 210*b* may be configured with a notch 232 formed in the top edge 232 of thigh plate 210*b*. This notch 232 also permits a shield 202 to be placed into the notch 232 to assist in holding the shield 202 in-place in front or to a side of the wearer. The notch 232 aids to relieve weight on the wearer's arms, and also aids to buttress the shield against strikes. The notch 232 and the ribs 230*a*, 230*b* may also assist keeping the shield 202 positioned higher in front of an individual or officer in a ready position during a confrontation that permits a quicker reaction time to respond to thrown items at the individual or officer while providing less stress on the arms of the individual or officer. The notch 232 may provide a higher positioning of a shield as compared to the ribs 230*a*, 230*b*.

A hip pad 215 may be removably attachable to the belt 225 by an anchoring mechanism 216. For example, the hip pad 215 may be removed and a gun holster 245 may be attached to the belt 225. The hip pad 215 or the gun holster 245 may be anchored to the belt 225 through the area 209 created between the two straps 220*a*, 220*b*, e.g. the U-shaped area defined therebetween.

Figure 3A:
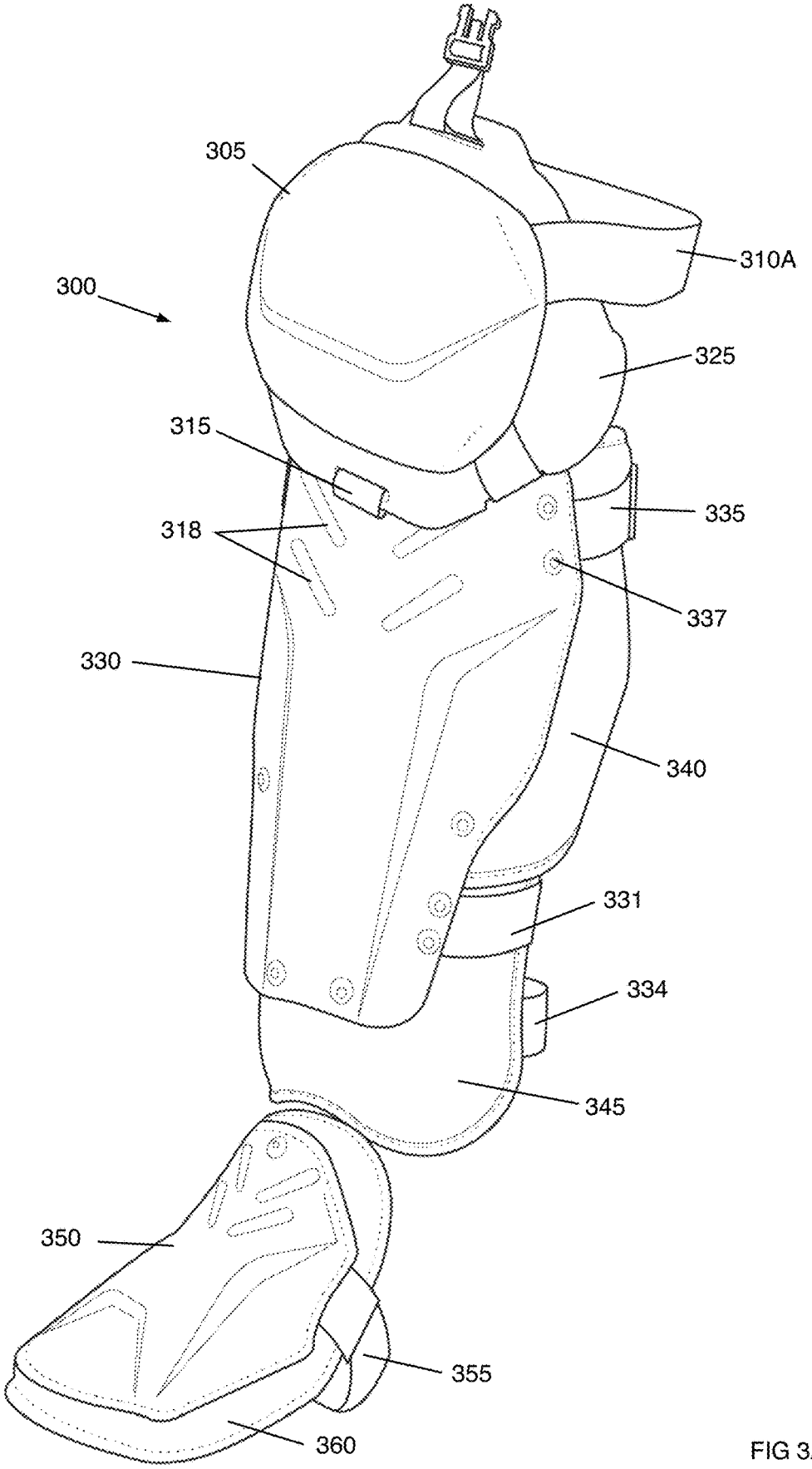
FIG. 3A is a perspective view of a leg protector assembly, configured according to principles of the disclosure.
Figure 3B:
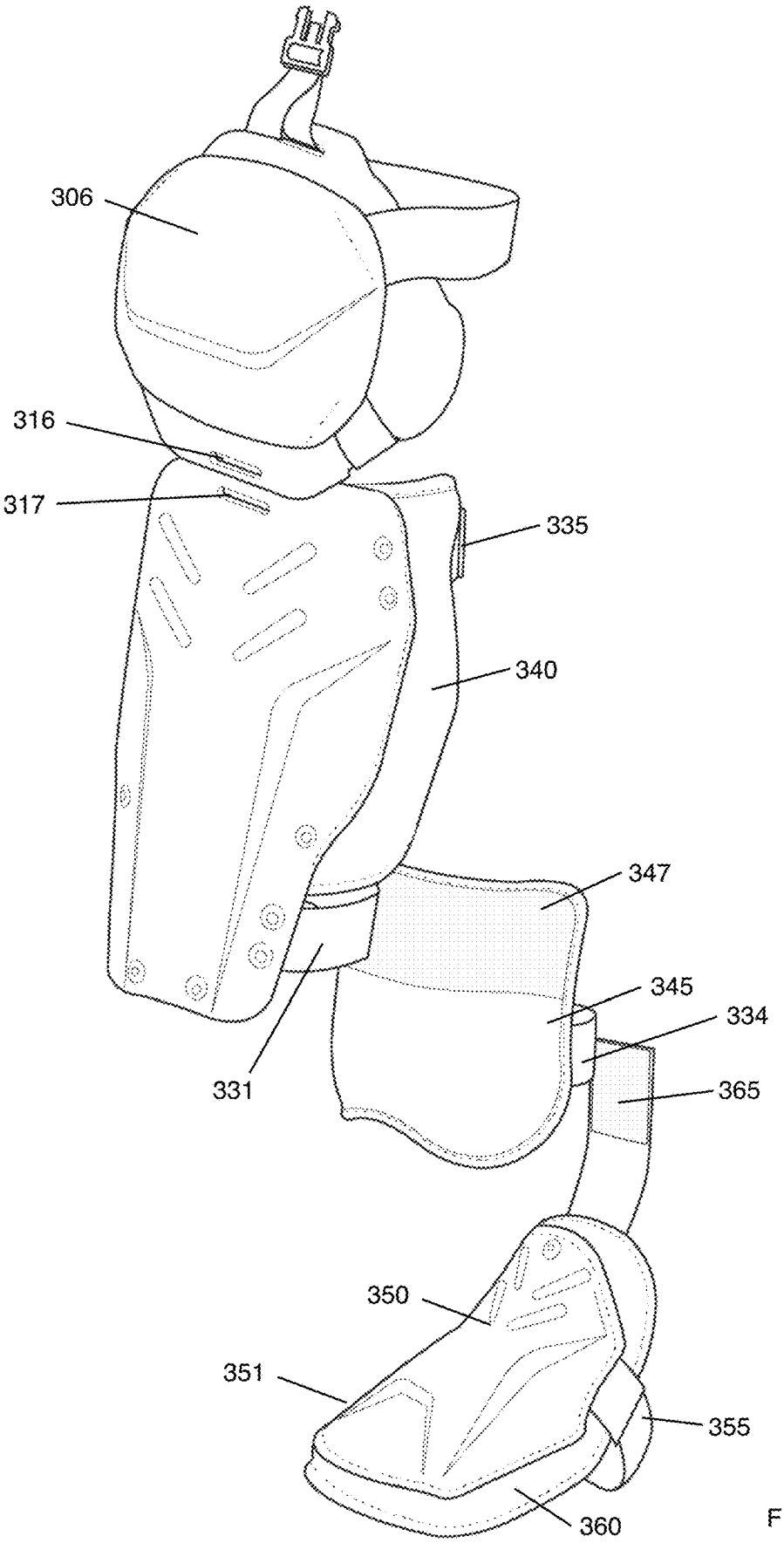
FIG. 3B is an exploded perspective view of the leg protector assembly of FIG. 3A, configured according to principles of the disclosure.
Figure 3C:
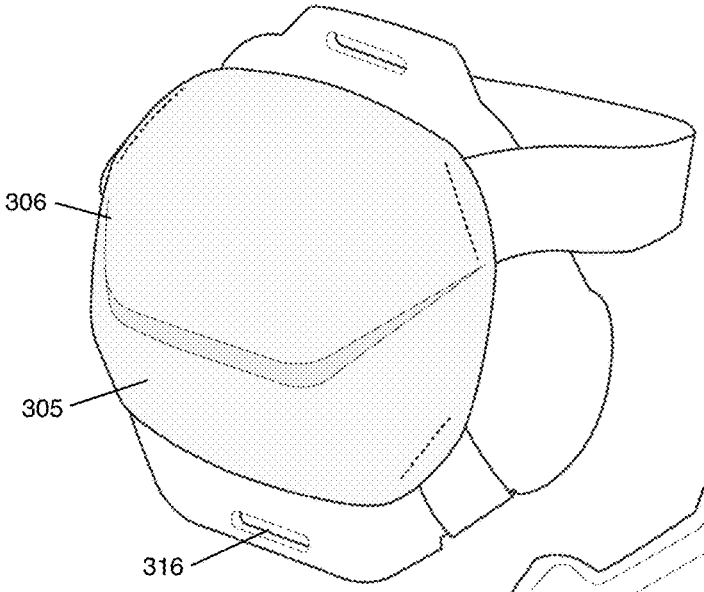
FIG. 3C is a perspective view of an example knee guard for use in the leg protector assembly of FIG. 3A.
Figure 3D:
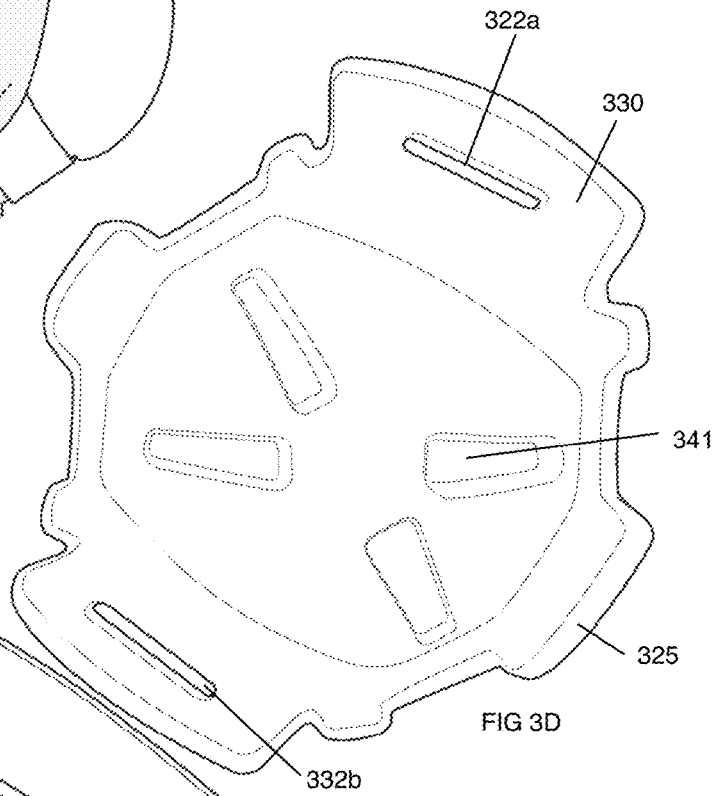
FIG. 3D is an illustration of a liner for use with the knee guard of FIG. 3C.
Figure 3E:
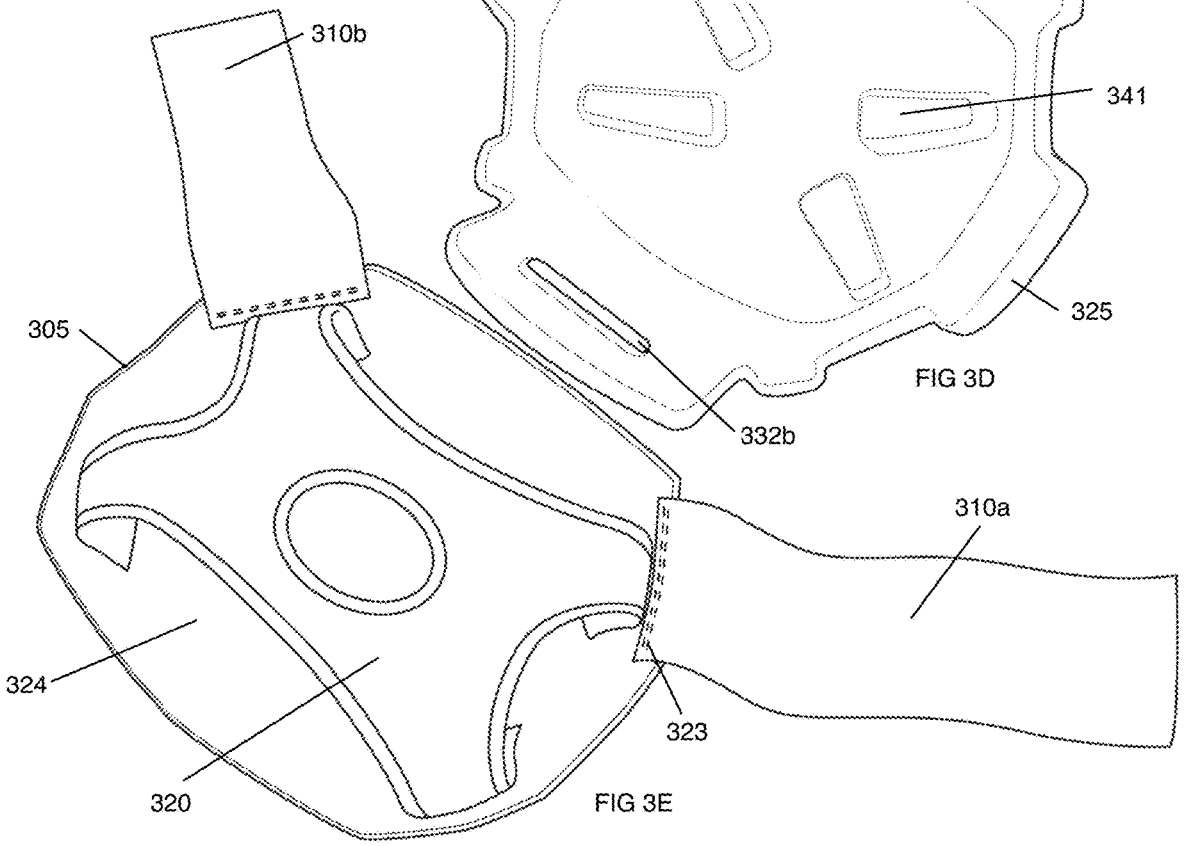
FIG. 3E is an illustration of a hammock configured on an inner surface of an outer plate of a knee guard, configured according to principles of the disclosure.

FIG. 3A is a perspective view of a leg protector assembly 300, configured according to principles of the disclosure. FIG. 3B is a partial exploded perspective view of the shin protector of FIG. 3A. FIG. 3C is a perspective view of a knee guard 305 for use in the leg protector assembly of FIG. 3A. FIG. 3D is an illustration of a liner 325 for use with the knee guard 305. FIG. 3E is an illustration of a hammock 320 configured on an inner surface 324 of the outer plate 306 of knee guard 305, configured according to principles of the disclosure. Knee guard 305, liner 325, hammock 320 and straps 310*a*, 310*b* may comprise a knee guard assembly. The shin guard plate 330 includes an upper pad 340 attached to the shin guard plate 330. The upper pad 340 may be permanently attached to the shin guard plate 330 by an attaching mechanism 337 such as e.g., rivets, bolts, screw or similar technique. A relocatable lower pad 345 may be attached to the upper pad 340 by a detachable and reconnectable technique 347 such as, e.g., hook and loop arranged on an outer upper section of the lower pad 345 to provide for adjusting of the lower pad 345 in relation to the shin guard plate 330, the upper pad 340 and the foot protector 350 thereby promoting a one-size-fits-most leg protection. A lower strap 334 may also permit for securing the lower pad 345 to and about a lower leg of a wearer. Lower strap 334 may utilize a hook and loop technique. Upper pad 340 and lower pad 345 may comprise a padded material that is comfortable for a wearer. The shin guard plate 330 may comprise a hard plastic or composite material sufficient to withstand and/or absorb significant physical blows. The shin guard plate 330 may be wider at the top near the knee area and tapering to a narrower width at the bottom near the ankle area of a wearer. A plurality of recesses 318 may be configured into the front face of the shin guard, which may arranged at 45 degrees to vertical. The plurality of recesses 318 may be arranged in pairs adjacent to one another in a vertical column and a horizontal row.

The shin guard plate 330, upper pad 340 and lower pad 345 may be secured to a leg of wearer by an adjustable securing mechanism, e.g., at least one strap 335 and/or strap 331. The shin guard plate 330 may be adjustably attached to the knee protector 305 by a connecting strap 315 via cut-outs 316, 317, and 322*a*, 322*b* of insert 325. Connecting strap 315 may be adjusted to permit vertical positioning of the shin guard plate 330 along the shin region of a leg promoting and providing a one-size-fits-most leg protection.

The foot protector 350 may comprise a hard shell 351 with a foot pad 360 attached to the shell 351 of foot protector 350. The hard shell 351 may comprise a hard plastic or composition material suitable for withstanding and/or absorbing considerable energy from physical blows. A shoe connecting mechanism 355 such as an adjustable strap may secure the foot protector 350 to a shoe or boot of a wearer. A foot protector connecting mechanism 365 may adjustably connect the foot protector 350 to the lower pad 345. The foot protector connecting mechanism 365 may be permanently or releasably connected at one end to the foot pad 360 and releasably connectable to the lower pad 345 at the other end, such as by hook and loop type of connection thereby promoting and providing a one-size-fits-most leg protection.

The shin guard plate 330, foot protector hard shell 351 and outer shell 306 of knee protector 306 may comprise a solid sturdy composition such as a hard plastic, composite, metal or similar material of sufficient durability to withstand and disperse energy imparted by significant physical blows thereto. The solid sturdy composition preferably comprises a lightweight material to minimize overall weight on a wearer.

The knee guard 305 may comprise the outer shell 306 which may comprise a plate and a liner 325 formed in a shape that matches the contour of the inner surface 324 of the outer shell 306 of knee protector 305. The outer shell 306 may comprise a hard material such as a hard plastic or composite material. The liner 325 may comprise a one-piece durable foam pad that may include a plurality of raised foam protrusions 341 to provide increased shock absorbency for protecting the knee of a wearer. A hammock 320 may be configured to receive the liner 325 thereunder. The liner 325 may be inserted under the hammock 320 and secured to outer shell 306 guard 305 by an adjustable connecting strap, such as e.g., strap 315 through slots 332*a*, 332*b* and one or more slots 316. Knee retaining straps 310*a*, 310*b* may be fastening behind a wearer's knee to hold the knee protector 305 secure to the wearer's knee. Knee retaining straps 310*a*, 310*b* may be attached such as, e.g., by stitching or other suitable securing mechanism 323 to the outer shell 306, such as to inner surface 324. The hammock 320 may be permanently connected to the inner surface 324 and may comprise a mesh type material that may assist in providing a shock absorbance in addition to the liner 325. The mesh type material may be a type of suspension panel and may be stretched to provide a flexing characteristic. The flexing characteristic may be analogous to a trampoline type effect.

Figure 4A:
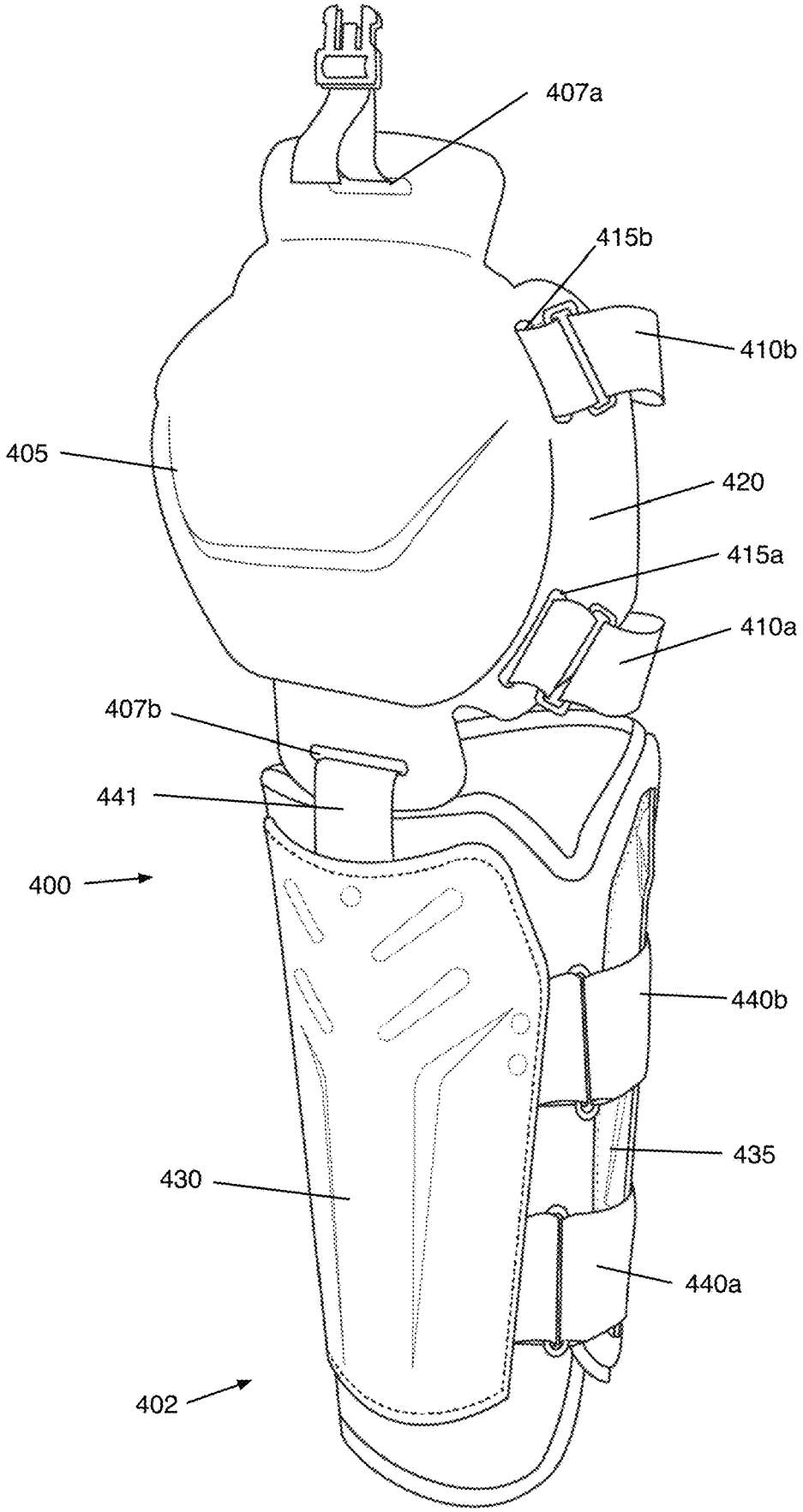
FIG. 4A is a first perspective view of an arm protector assembly, configured according to principles of the disclosure.
Figure 4B:
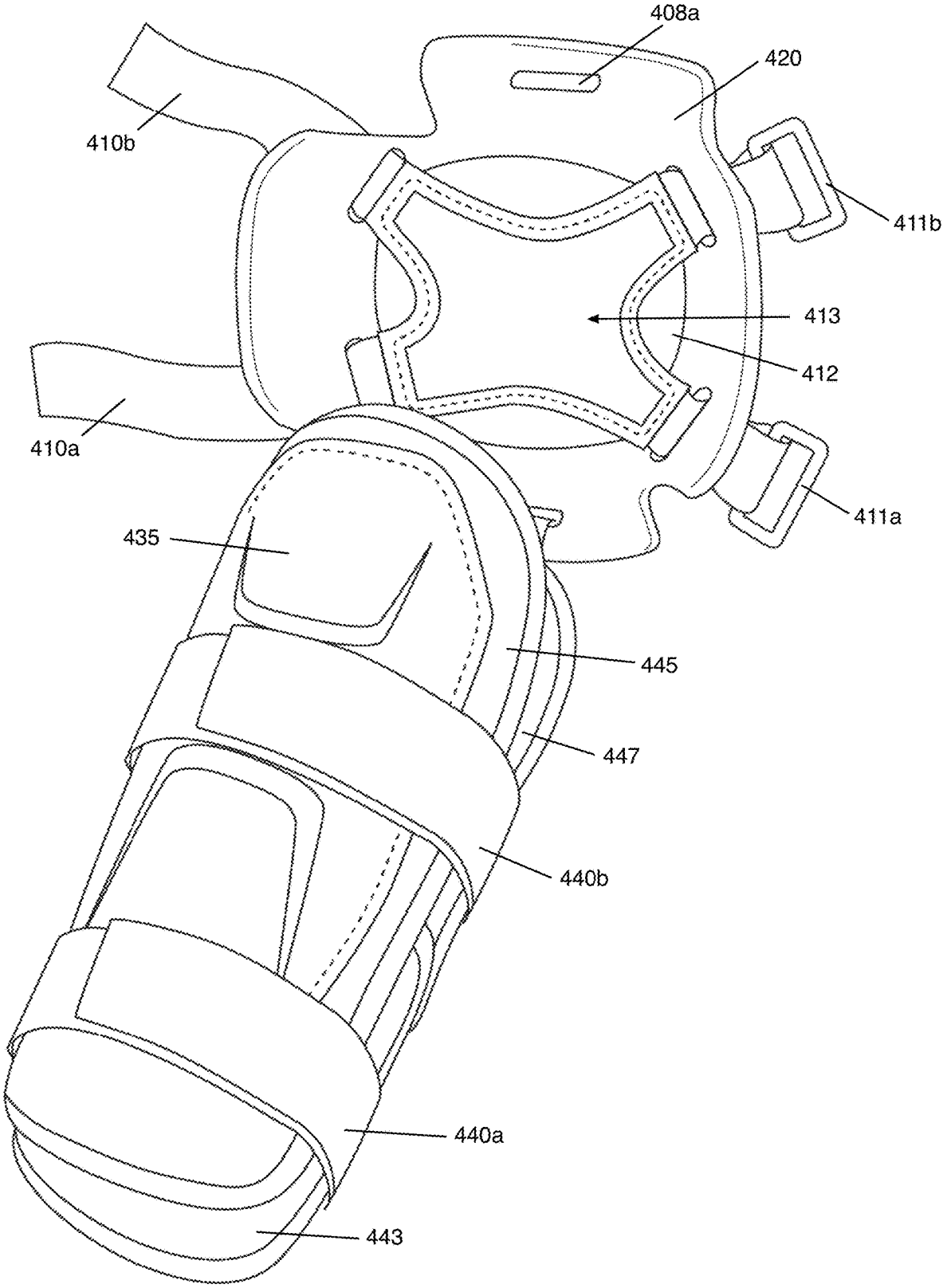
FIG. 4B is a second perspective view of an arm protector assembly, configured according to principles of the disclosure.
Figure 4D:
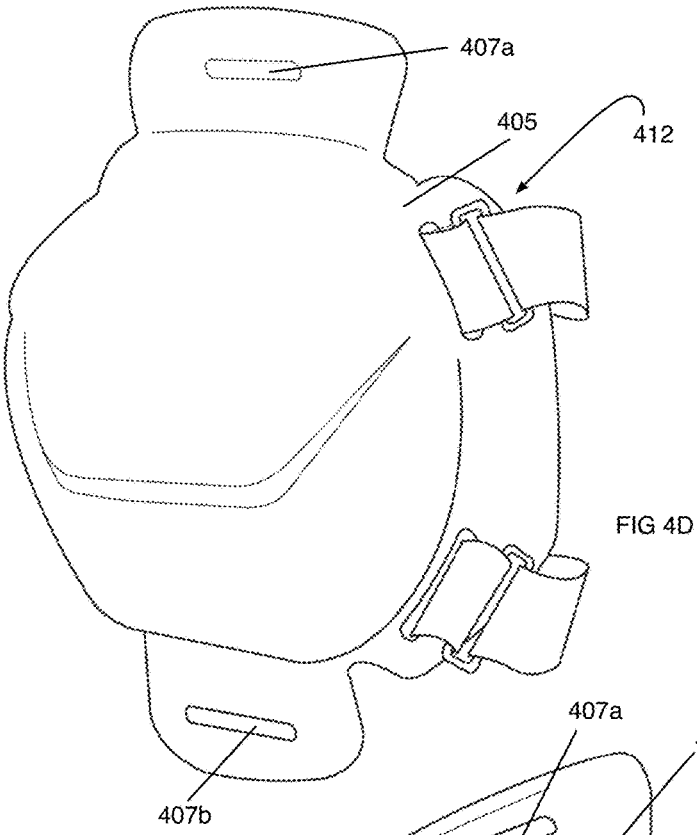
FIG. 4D is a front perspective view of an elbow protector, configured according to principles of the disclosure.
Figure 4C:
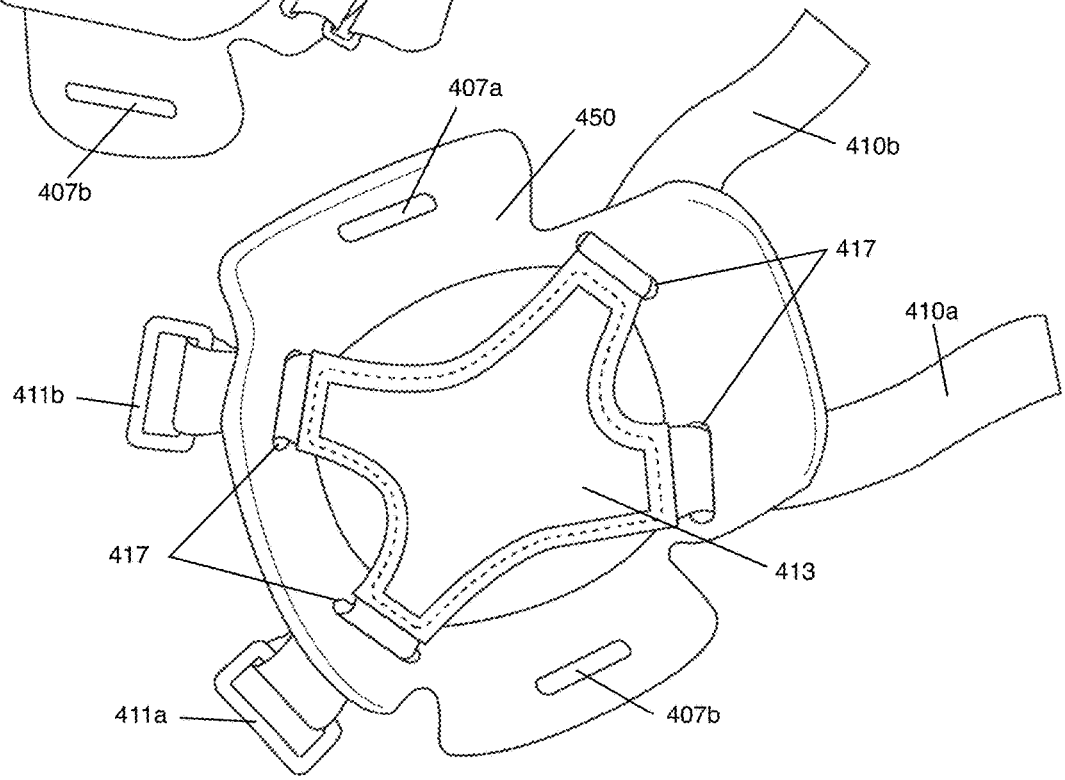
FIG. 4C is an example rear view of an elbow protector, configured according to principles of the disclosure.

FIG. 4A is a first perspective view of an arm protector assembly 400, configured according to principles of the disclosure. FIG. 4B is a second perspective view of an arm protector assembly, configured according to principles of the disclosure. FIG. 4C is an example of a rear view of an elbow protector 405, configured according to principles of the disclosure. FIG. 4D is a front perspective view of an elbow protector 405, configured according to principles of the disclosure. Elbow protector 405 may comprise a durable foam material, but may comprise a hard material such as, e.g., plastic. The elbow protector may include a portion 420 that extends partially around an elbow area. Elbow protector 405 may be configured to form a concave cavity 412 for accepting an elbow therewithin. An elbow hammock 413 may be arranged and positioned above the concave cavity 412. The elbow hammock 413 may provide a trampoline type effect to absorb energy. The elbow protector 405 and elbow hammock 413 may connect about an elbow via, e.g., adjustable straps 410*a*, 410*b*, loops 411*a*, 411*b*, and slots 417. The plurality of adjustable straps 410*a*, 410*b* also passing through the elbow liner 420.

The elbow protector 405 may adjustably connect with the upper arm protector 110 (FIG. 1A) via adjustable connecting mechanism 130 (FIG. 1B) through slot 407*a*, thereby promoting and providing a one-size-fits-most arm protection.

The upper arm protector 110 may comprise a hard plastic, composite material or similar material. The upper arm protector 110 may comprise a raised area near the top of the upper arm protector 110 to provide added deflection capability, and may serve to strengthen the upper arm protector 110. The raised area may be of a raised triangular shape, as shown in FIG. 1A.

The lower arm protection assembly 400 may include flexible connectivity with elbow protector 405 using an elastic type connecting mechanism 441 and slot 407*b*. In some applications, hook and loop type of connecting mechanism may be employed. The lower arm protection assembly 400 may comprise an outer plate 430 connected to an outer pad 447, the outer plate and outer pad 447 positionable for protecting an outer portion of a forearm. The outer plate 430 may include diagonal recesses 442, which may comprise opposing recesses at about 90 degree angles to one another. The lower arm protection assembly 400 may further comprise an inner plate 435 connected to an inner pad 445, positionable for protecting an inner portion of a forearm. A repositionable pad 443 may further supply added padding on a wearer's arm for increased protection. The least one repositionable pad 443 may include hook and loop techniques for repositionably reconnecting to the inner pad 445. The plates 430 and 435 may be connected to their respective pads 447, 445 by a permanent connecting technique such as, e.g., by being sewn, stitched, or other permanent connecting technique. The inner plate 435 and inner pad 445 may be adjustable with respect to one another for permitting a range of arm sizes. Straps 440*a*, 440*b* which may include a hook and loop type connector may hold the lower arm protection assembly 400 to a wearer's forearm. Straps 440*a*, 440*b* permit adjustability for a wide range of forearm circumferences.

Figure 5A:
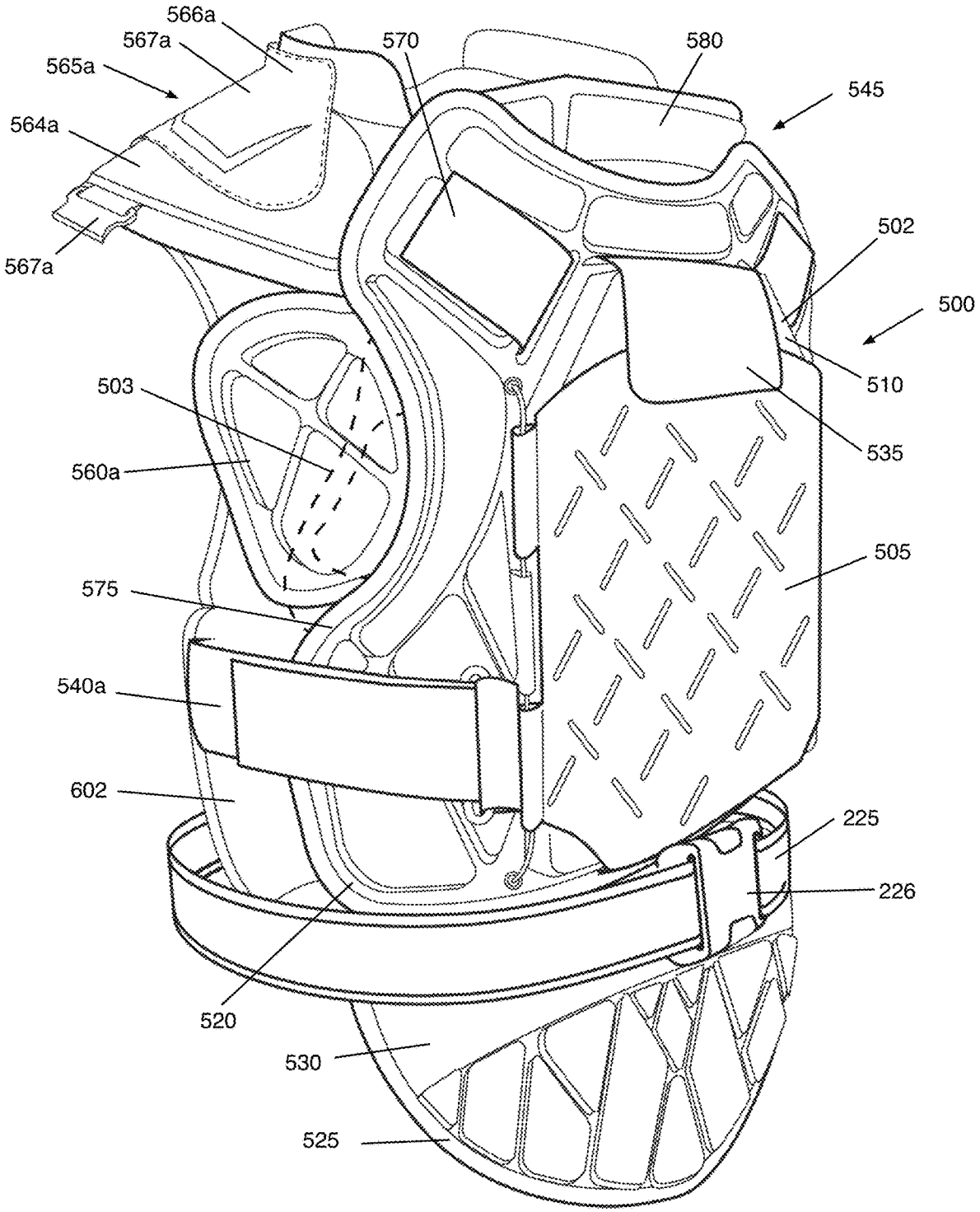
FIG. 5A is a front perspective view of a torso protector assembly, configured according to principles of the disclosure.
Figure 5B:
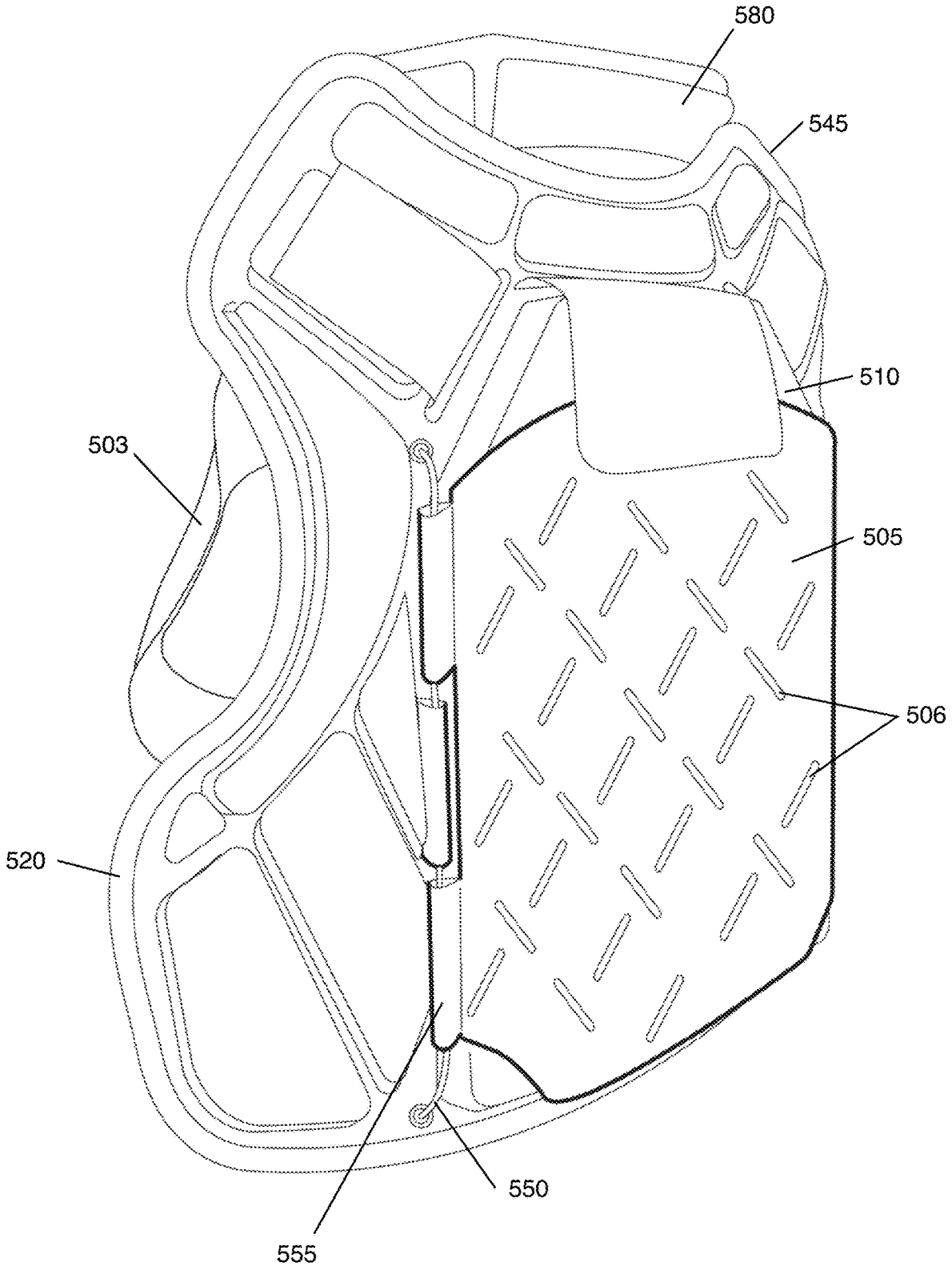
FIG. 5B is a front perspective view of a front pad of the torso protector assembly of FIG. 5A.
Figure 5C:
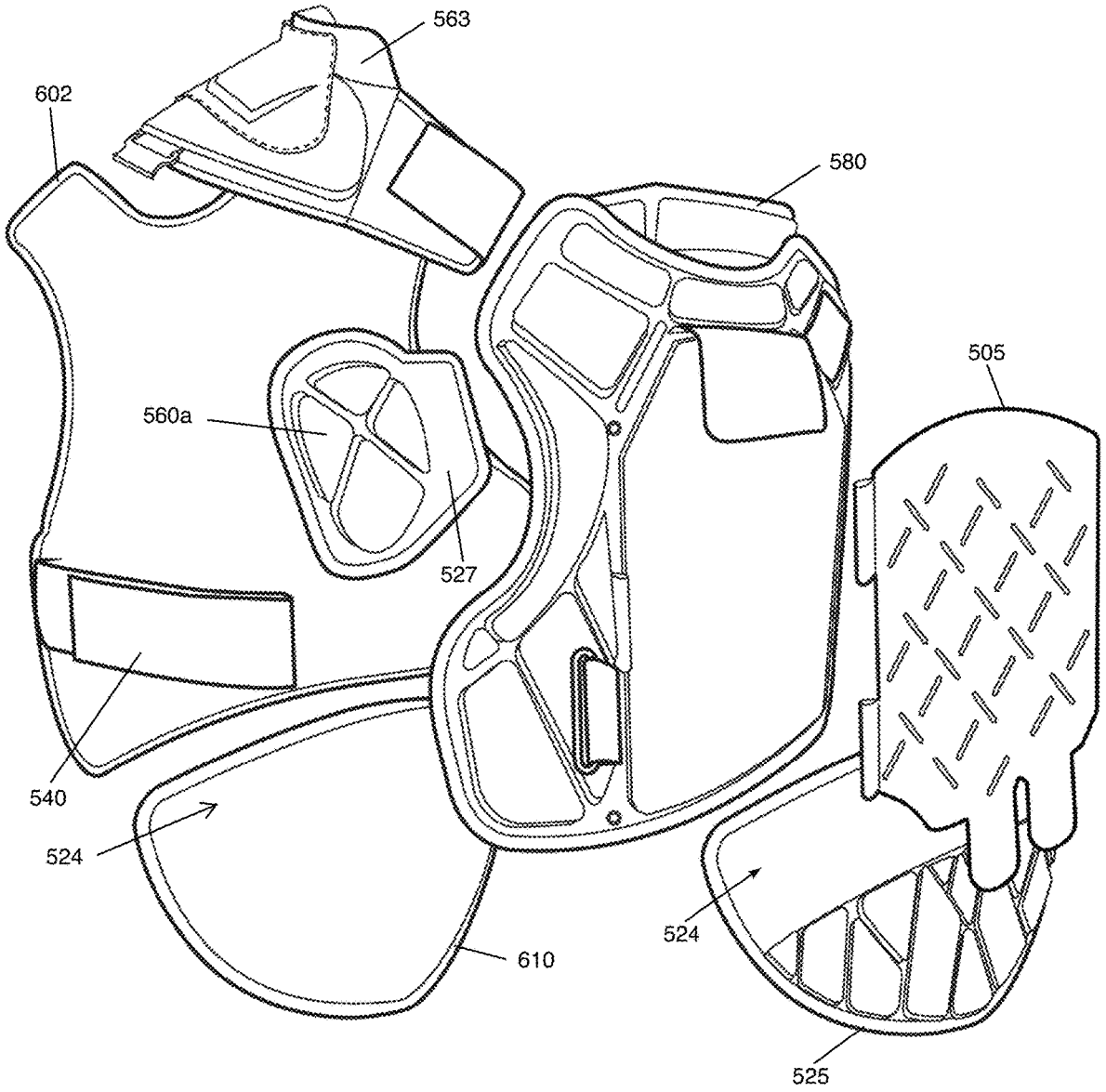
FIG. 5C illustrates in part an exploded front perspective view of the torso protector assembly of FIG. 5A.
Figure 5D:
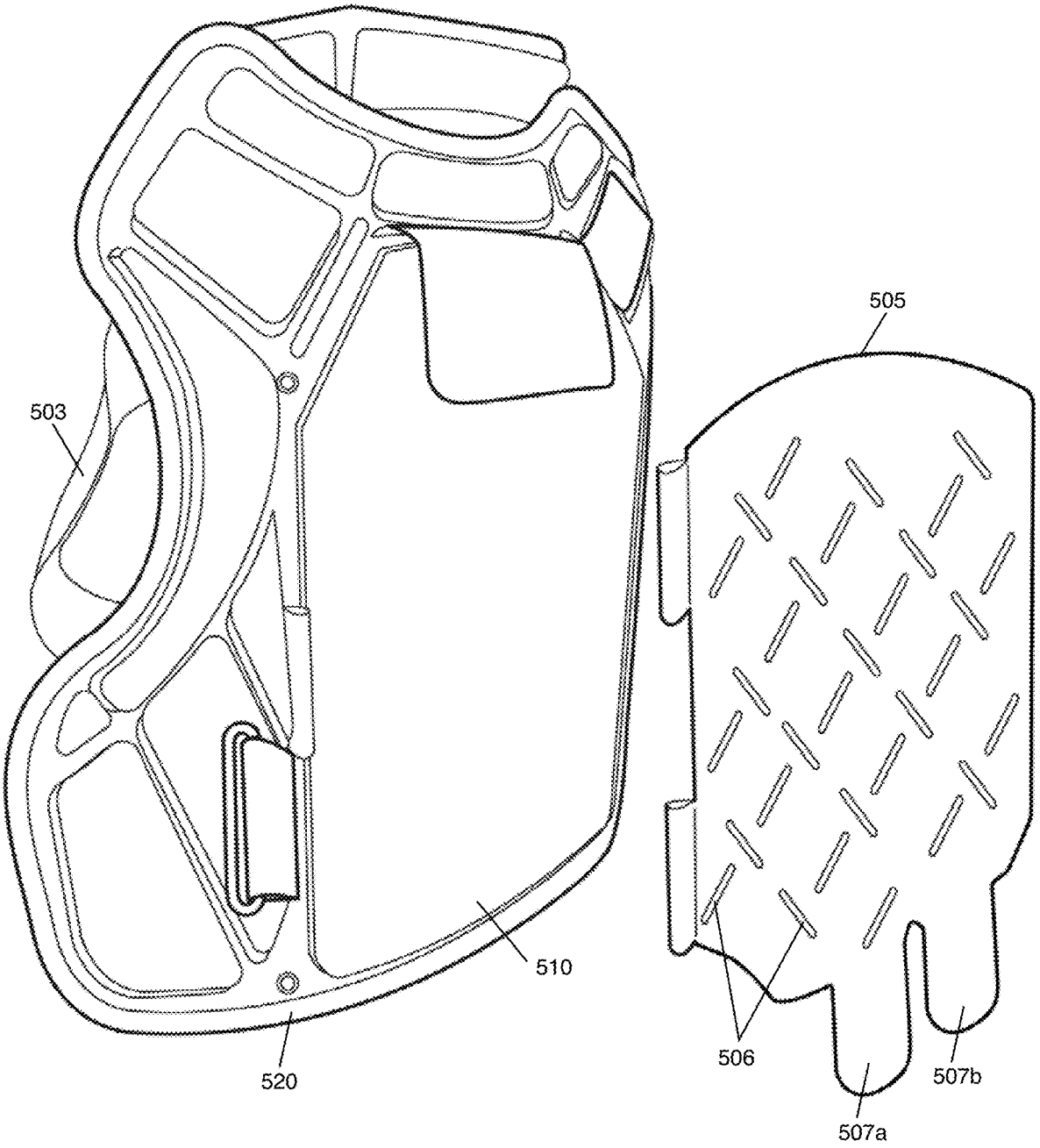
FIG. 5D is an exploded front perspective view of the front pad of FIG. 5B, configured according to principles of the disclosure.
Figure 5E:
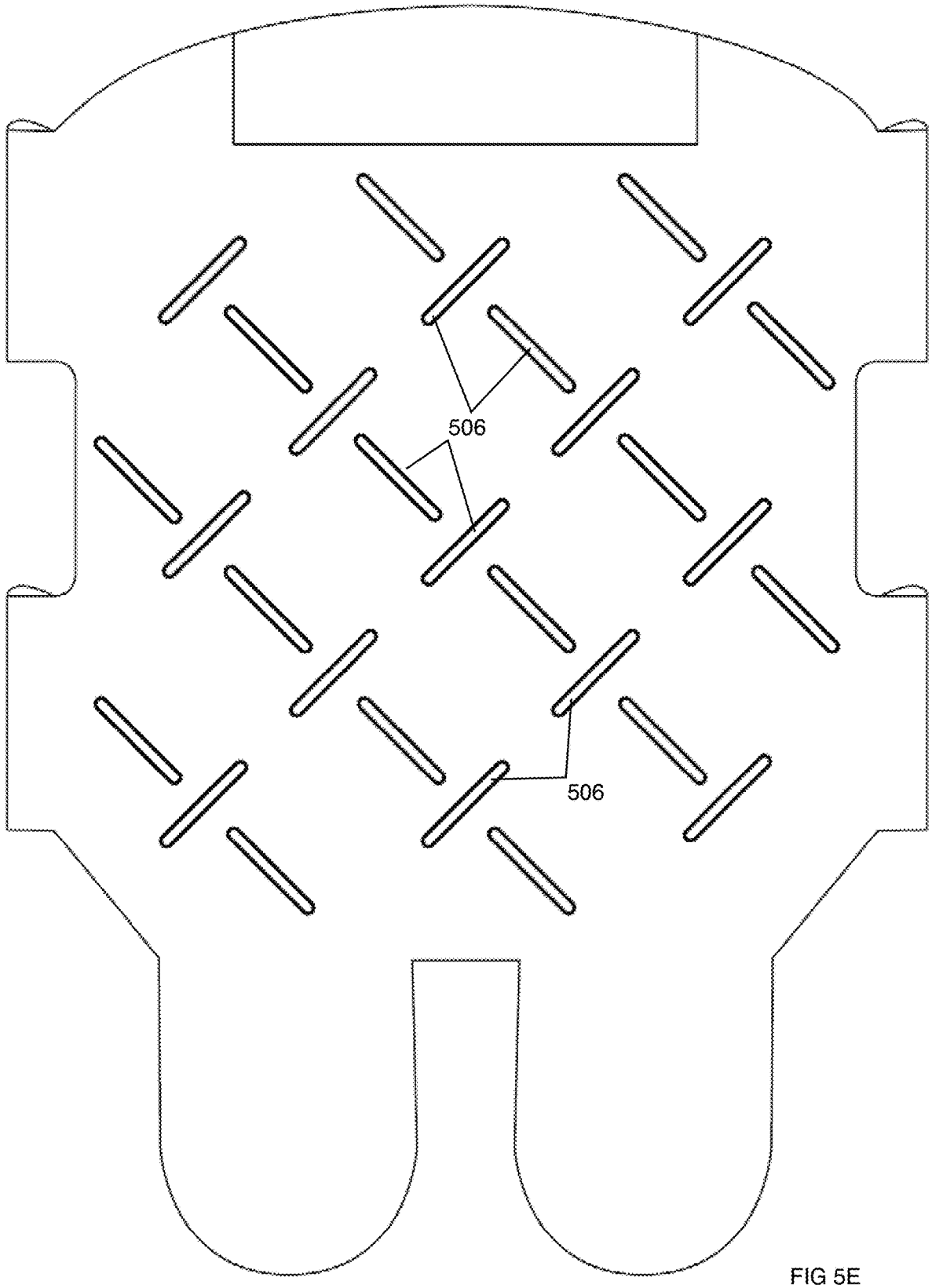
FIG. 5E is an illustration of an adjustable plate pocket of FIG. 5D.

FIG. 5A is a front perspective view of a torso protector assembly 500, configured according to principles of the disclosure. FIG. 5B is a front perspective view of a front pad of the torso protector assembly of FIG. 5A. FIG. 5C illustrates in part an exploded front perspective view of the torso protector assembly of FIG. 5A. FIG. 5D is an exploded front perspective view of the front pad of FIG. 5B. FIG. 5E is an illustration of an adjustable plate pocket of FIG. 5D.

The torso protector assembly 500 may include the front torso protector assembly 501 and rear protector assembly 600. Front torso protector assembly 501 includes an adjustable plate pocket 505 configured to hold an interchangeable plate 510 to protect a wearer against blunt trauma and/or gunshot wounds. The plate 510 may be configured with bevel corners 502 along the top of the plate 510. The plate 510 may be available in different contours and thicknesses, and in different materials depending on the level of protection desired. The plate 510 may comprise a ballistic plate. Since different plate 510 thicknesses might be used, the adjustable plate pocket 505 is free floating and is not permanently anchored to the chest or back components. The bottom of the plate pocket 505 may be connected to the back side of the chest pad 520 via a releasable connector 507*a*, 507*b* (FIG. 5D) such as e.g., a hook and loop connection to allow adjustments for different thicknesses of plates 510. At the top of the plate pocket 505, a flap 535 may secure the plate 510 within the pocket 505, such as by a hook and loop connection. The flap 535 may be secured to the inner side of the chest pad 520. Each side, left and right, of the plate pocket 505 may be secured to the chest pad 520 by one or more loop-channels 555 that allow an flexible or elastic chord 550 to pass through and pull the plate 510 against or into the chest pad 520. The chord 550 may be anchored at one end of the plate pocket, top or bottom, to the back side of the chest pad 520. The chord 550 may be adjustable by a locking mechanism that allows for adjustment and to secure the plate pocket 505 and plate insert 510 accordingly. The chest pad 502 may be connected to the back pad 602 via at least one adjustable connecting strap 540*a*, 540*b*, which may comprise, e.g., a hook and loop connection. The front torso assembly may also include abdominal pad 525 configured with a grooved or recessed area 530 that is of sufficient depth to accept and hold a belt 225 while also permitting vertical adjustments of the abdominal pad 525 in relation to the chest pad 520 to accommodate shorter or longer torsos. The abdominal pad 525 may releasable connectable 524 to the back of the chest pad 520 such as, e.g., via a hook and loop mechanism to permit repositioning for different sized individuals.

The front torso protector assembly 501 may include one or more adjustable arm pads 560*a*, 560*b* which are configured to provide side protection to the ribs and arms. The one or more adjustable arm pads 560*a*, 560*b* may adjustably connect proximate at a curvature 575 in the outer edge of the chest pad 520. The curvature 575 provides some space for the one or more adjustable arm pads 560*a*, 560*b* to be positioned under an arm proximate the ribs of the wearer. The one or more adjustable arm pads 560*a*, 560*b* may attach to the front torso protector assembly 501 directly with an adjustable securing mechanism, such as a hook and loop mechanism 527. In some applications, the one or more adjustable arm pads 560*a*, 560*b* may attach to the rear torso protector assembly 600 with an adjustable securing mechanism, such as a hook and loop mechanism 527.

The front torso protector assembly 501 may further include one or more shoulder pad assemblies 565*a*, 565*b*. The one or more shoulder pad assemblies 565*a*, 565*b* may comprise a shoulder plate 567*a*, 567*b* that may comprise a hard plastic or similar hard material sufficient to absorb or deflect energy applied against the shoulder plate 567*a*, 567*b*. The shoulder plate 567*a*, 567*b* may be connected to the shoulder pad 564*a*, 564*b* such as, e.g., by being sewn or similar connection technique. The shoulder pad 564*a*, 564*b* may comprise a soft comfortable material for padding the plates 567*a*, 567*b* against the wearer, and may comprise, e.g., a cotton or synthetic material, similar material, or combinations thereof. The shoulder plate 567*a*, 567*b* may generally conform to a shape of a top of a shoulder and be configured with a neck protector which may comprise elevated protrusions 566*a*, 566*b* rising from the shoulder plate 567*a*, 567*b* at a first end of the shoulder pad assembly 565*a*, 565*b* closest to the neck of a wearer. Elevated protrusions 566*a*, 566*b* may comprise the same material as the shoulder plate 567*a*, 567*b*. Shoulder pad 564*a*, 564*b* may also be configured with elevated portions 563 that match the elevated protrusions 566*a*, 566*b* rising from the shoulder plate 567*a*, 567*b*. The second end opposite the first end may be configured with a connecting mechanism such as, e.g., a buckle 567*a*, 567*b* to permits adjustable connectivity to the upper arm protector 110 such as via a strap, or other adjustable mechanism, the mechanism may comprise a hook and loop mechanism. The shoulder pad assembly 565*a*, 565*b* may adjustably connect to the chest pad 520 via adjustable connecting mechanism 570 which permits a range of sizing options for wider or narrower chest widths, thereby promoting a one-size-fits-most capability. The shoulder pad assembly 565*a*, 565*b* may adjustably connect to the back pad 602 in a similar manner via adjustable connecting mechanism 630. Adjustable connecting mechanism 570, 630 may comprise a hook and loop mechanism. The front torso protector assembly 501 may further include a front neck protector 580 connected to the chest pad 520, proximate a top end 545 of the chest pad 520.

The front torso protector assembly 501 may include one or more rescue straps 503 configured on one or both sides of chest pad 520. The one or more rescue straps 503 may be of sufficient strength to lift and/or pull a downed individual.

FIG. 5D illustrates adjustable plate pocket 505 and the 45 degree anchor points 506 that allows for the attachment of various MOLLE-compatible pouches or accessories such as e.g. extra ammo, mace, a stun gun, and similar accessories. As shown in FIG. 5E, in one aspect, the 45 degree arrangement permits easier access by an individual as compared with traditional horizontal type MOLLE-compatible systems. The 45 degree arrangement may be in reference to the vertical left side and right side of the plate pocket 505. The anchor points 506 may be arranged as two different rows oriented at 90 degree angles to one another. The anchor points 506 may be arranged as a plurality of different rows oriented at 90 degree angles to one another. The different rows may be interspersed among one another.

Figure 5F:
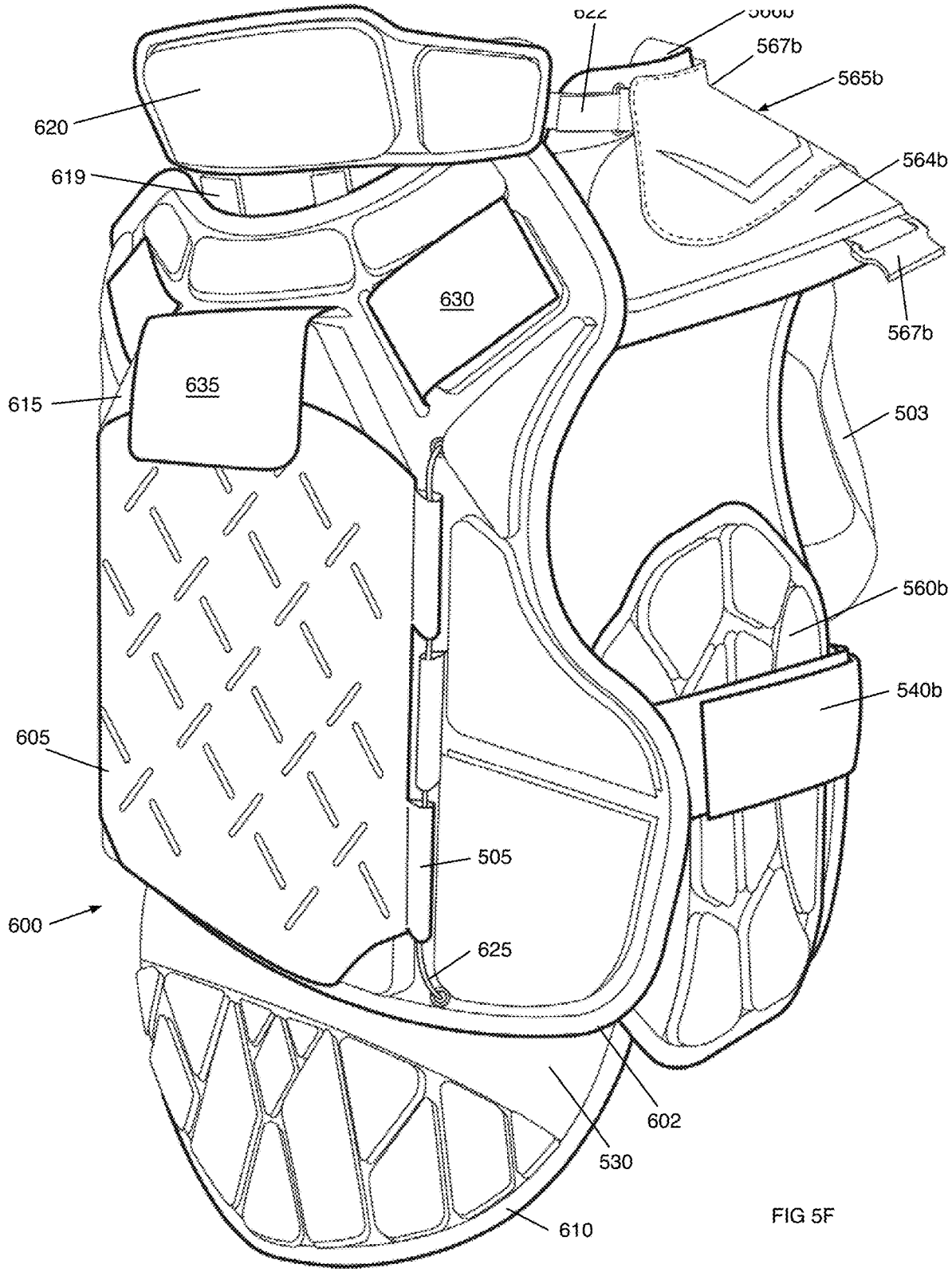
FIG. 5F is a perspective view of a rear torso protector assembly, configured according to principles of the disclosure.

FIG. 5F is a perspective view of a rear torso protector assembly 600, configured according to principles of the disclosure. The rear torso protector assembly 600 may be constructed in a similar fashion as the front torso protector assembly 501. The rear torso protector assembly 600 may comprise a back pad 602, a back plate pocket 605 and a back plate 615, which may comprise a plate in the same manner as the plate 502. The back plate 615 many comprise a ballistic plate.

Since different plate 615 thicknesses might be used, the adjustable back plate pocket 605 may be free floating and may not permanently anchored to the back components. The bottom of the plate pocket 605 may be connected to the back side of the back pad 602 via a releasable connector such as, e.g., flaps 507*a*, 507*b*, which may be e.g., a hook and loop connection to allow adjustments for different thicknesses of plates 615. At the top of the back plate pocket 605, a flap 635 may secure the plate 615 within the pocket 605, such as, e.g., by a hook and loop connection. The flap 635 may be secured to the inner side of the back pad 602. Each side, left and right, of the plate pocket 605 may be secured to the back pad 602 by one or more loop-channels 555 that allow a flexible or elastic chord 625 to pass through and pull the back plate 615 against or into the back pad 602. The chord 625 may be anchored at one end of the back plate pocket 605, top or bottom, to the back side of the back pad 602. The chord 625 may be adjustable by a locking mechanism that allows for adjustment and to secure the back plate pocket 605 and back plate 615 accordingly. The back pad 602 may be connected to the chest pad 520 via at least one adjustable connecting strap 540*a*, 540*b*, which may comprise, e.g., a hook and loop connection. The front torso assembly may also include abdominal pad 525 configured with a grooved or recessed area 530 that is of sufficient depth to accept a belt 225 while also permitting vertical adjustments of the abdominal pad 525 in relation to the chest pad 520 to accommodate shorter or longer torsos. The abdominal pad 525 may releasably connect 524 to the back of the chest pad 520 such as via a hook and loop mechanism. The shoulder pad assembly 565*a*, 565*b* may adjustably connect to the back pad 602 via adjustable connecting mechanism 630 which permits a range of sizing options for wider or narrower chest widths, thereby promoting a one-size-fits-most capability.

A lower back pad 610, similar to the abdominal pad 525, serves to provide protection to the lower back of a wearer. The lower back pad 610 may be configured with a grooved or recessed area 530 in a like manner as the abdominal pad 525. The grooved or recessed area 530 may be configured to receive a belt 225 thereon to assist in maintaining the belt about a wearer. The lower back pad 610 may releasably connect to the back side of the back pad 602 such as, e.g., via a hook and loop mechanism.

The rear torso protector assembly 600 may further comprise a back neck protector 620 that may comprise a pad that surrounds, at least in part, a neck of the wearer to provide protection from the back of the neck area. The back neck protector 620 may be adjustably connectable to the back pad 602 to permit flexible positioning of the back neck protector 620 in relation to the back pad 602. The back neck protector 620 may be removeably and adjustably connectable 616 to the back pad 602 via an adjustable mechanism 616 such as, e.g., a buckle and/or a hook and loop type connecting mechanism. Also, the back neck protector 620 may be removeably and adjustably connectable to the shoulder pad assemblies 565*a*, 565*b* by connector 622 which may be a releasable connector such as, e.g., hook and loop. The back neck protector 620 may be repositionable for different sized individuals, and provides for a 4-point secured anchor attaching system.

Back plate pocket 605 may comprise 45 degree anchor points 506 as described previously in relation to FIGS. 5E and 5F that allows for the attachment of various MOLLE-compatible pouches or accessories such as e.g. extra ammo, mace, a stun gun, or similar accessories.

Figure 6A:
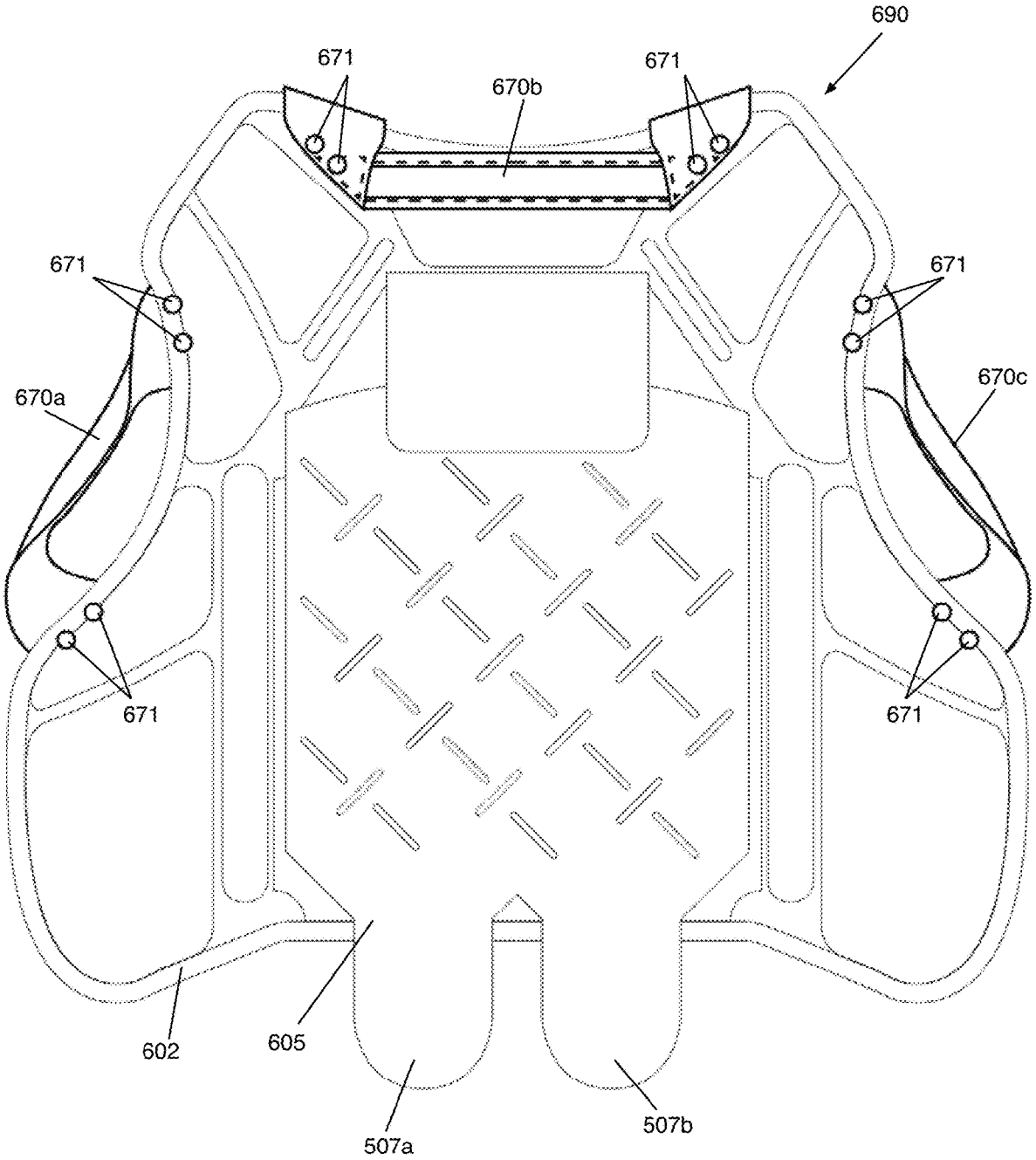
FIG. 6A is an illustration of a back panel of a torso protector assembly, with a lift handle assembly, configured according to principles of the disclosure
Figure 6B:
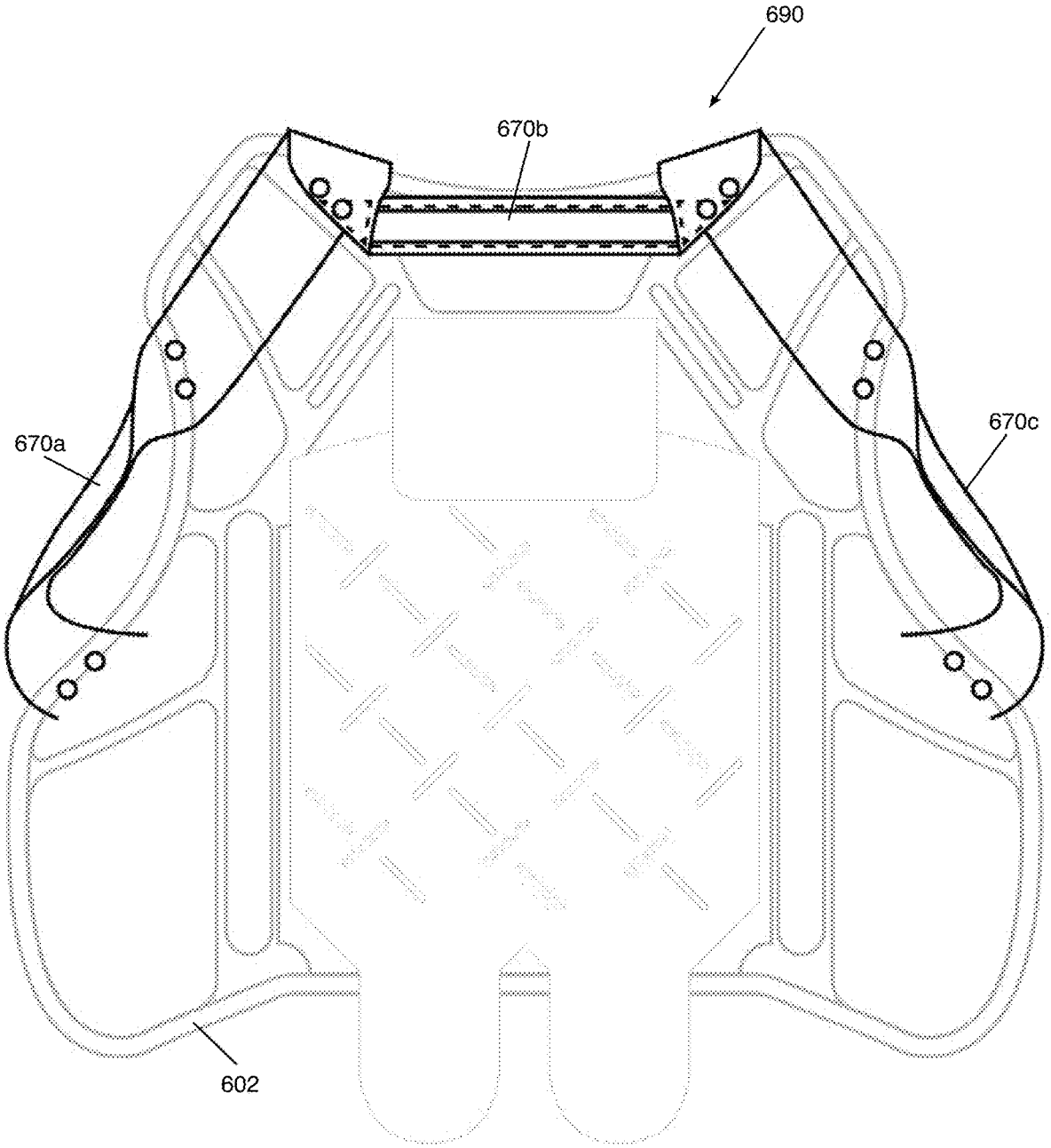
FIG. 6B is an illustration of the back panel of a torso protector assembly, with a lift handle assembly of FIG. 6A, but with the lift handle assembly highlighted.

FIG. 6A is an illustration of a back panel of a rear torso protector assembly 600, with a lift handle assembly 690, configured according to principles of the disclosure. FIG. 6B is an illustration of the back panel of a torso protector assembly, with a lift handle assembly of FIG. 6A, but with the lift handle assembly 690 highlighted. The lift handle assembly 690 may comprise a plurality of handles 670*a*, 670*b*, 670*c* that are attached to the rear torso protector assembly 600 at several points 671 such as, e.g., by riveting or other permanent attaching technique. The lift handle assembly 690 provides for easier lifting of a downed individual. The plurality of handles 670*a*, 670*b*, 670*c* or recuse straps may be configured proximate each shoulder and the neck area providing multiple options to lift a downed individual, e.g., an individual who may have fallen in a position that perhaps only one of the plurality of handles 670*a*, 670*b*, 670*c* is easily accessible to a rescuer in a time sensitive situation. For example, if an officer wearing the torso assemblies 500, 600 may be downed, such as, e.g., being injured or disabled. A rescuer may be able to lift the downed officer and carry and/or drag the officer to safety by any one of the handles 670*a*, 670*b*, 670*c* that are secured to the rear torso protector assembly 600. The plurality of handles 670*a*, 670*b*, 670*c* may comprise a single piece of durable material such as, e.g., webbing material.

In one aspect, the protective gear as configured according to principles of this disclosure may provide an overall body protection system that includes a unified suspension system of the various assemblies herein that adjustably suspends directly or indirectly from the topmost assembly, the one or more shoulder pad assemblies 565*a*, 565*b*. The upper arm protectors 110 may adjustably suspend from the one or more shoulder pad assemblies 565*a*, 565*b*. The plurality of lower arm protection assemblies 400 may adjustably suspend from respective upper arm protectors 110. Torso protection assemblies 500, 600 may adjustably suspend from the one or more shoulder pad assemblies 565*a*, 565*b*. The one or more thigh protection assemblies 200 may adjustably suspend from the torso protection assemblies 500, 600 such as via the belt 225 and the grooved or recessed area 530 of the abdominal pad 525 and/or the lower back pad 610. The one or more leg protection assembly 300 may adjustably suspend from the one or more thigh protection assemblies 200. The one or more foot protectors 350 may adjustably suspend from a respective one of the leg protection assemblies 300. In this manner the protective gear may be unified as a complete system from shoulders to feet with one component adjustably connected to another adjacent component. In some applications, not all assemblies may be employed, nor necessarily required to be connected in the same relationship.

While the invention has been described in terms of examples, those skilled in the art will recognize that the invention can be practiced with modifications in the spirit and scope of the appended claims. These examples are merely illustrative and are not meant to be an exhaustive list of all possible designs, embodiments, applications or modifications of the invention.

What is claimed:

1. A thigh protector assembly comprising:

an upper portion comprising two straps for attaching at least one thigh protector to a belt, the two straps defining a space therebetween for permitting attaching of a hip pad or holster to the belt through the defined space; and a lower portion comprising a pair of thigh plates attached to a thigh pad forming the at least one thigh protector, the pair of thigh plates defining a vertical hinge area therebetween when the at least one thigh protector is worn, the pair of thigh plates configured to permit the at least one thigh protector to be opened and placed about a thigh of a wearer positioning the vertical hinge area on a lateral side of the thigh in relation to a front side of the thigh, wherein the lower portion further comprises at least one rib extending laterally from a face of one of the pair of thigh plates and a post extending vertically from the at least one rib for receiving and supporting a shield on the at least one rib behind the post when the at least one thigh protector is worn.

2. The thigh protector assembly of claim 1, wherein the vertical hinge area permits opening and placing of the at least one thigh protector about a wide range of thigh circumferences for providing a one-size-fits-many thigh protector.

3. The thigh protector assembly of claim 1, wherein the lower portion further comprises at least one notch formed in a top edge of one of the pair of thigh plates for assisting in keeping a shield in place on the thigh protector assembly.

4. The thigh protector assembly of claim 1, further comprising an adjustable securing mechanism for closing the lower portion about a thigh of the wearer.

* * * * *